US007013612B2

(12) United States Patent
Haddock

(10) Patent No.: US 7,013,612 B2
(45) Date of Patent: Mar. 21, 2006

(54) MULTI-PIECE CLAMP FOR STANDING SEAMS

(76) Inventor: Robert M. M. Haddock, 8655 Table Butte Rd., Colorado Springs, CO (US) 80908

( * ) Notice: Subject to any disclaimer, the term of this patent is extended or adjusted under 35 U.S.C. 154(b) by 0 days.

(21) Appl. No.: 10/746,596

(22) Filed: Dec. 23, 2003

(65) Prior Publication Data

US 2004/0134151 A1 Jul. 15, 2004

Related U.S. Application Data

(63) Continuation of application No. 09/758,805, filed on Jan. 11, 2001, now abandoned.

(51) Int. Cl.
*E04D 1/34* (2006.01)

(52) U.S. Cl. ..... 52/545; 52/528; 52/537; 52/568; 52/571

(58) Field of Classification Search ..... 52/15, 52/24, 27, 52, 528, 535, 536, 538, 540, 545, 52/512, 698, 745.21, 519, 394, 568, 537, 52/543, 25, 571
See application file for complete search history.

(56) References Cited

U.S. PATENT DOCUMENTS

| | | | | |
|---|---|---|---|---|
| 1,465,042 A | | 4/1921 | Hruska | |
| 1,511,529 A | | 9/1923 | Standlee | |
| 1,735,937 A | | 6/1924 | Shaffer | |
| 2,183,844 A | * | 12/1939 | Murphy | 52/277 |
| 2,340,692 A | | 9/1942 | Ridd | |
| 3,039,161 A | | 8/1960 | Gagnon | |
| 3,307,235 A | | 2/1965 | Hennings | |
| 3,503,244 A | | 5/1967 | Joslin | |
| 3,590,543 A | | 7/1971 | Heirich | |
| 3,817,270 A | | 6/1974 | Ehrens et al. | |
| 3,904,161 A | | 9/1975 | Scott | |
| 3,986,746 A | | 10/1976 | Chartier | |
| 4,200,107 A | | 4/1980 | Reid | |
| 4,261,384 A | | 4/1981 | Dahlbring | |
| 4,351,140 A | * | 9/1982 | Simpson | 52/542 |
| 4,546,586 A | | 10/1985 | Knudson | |
| 5,228,248 A | * | 7/1993 | Haddock | 52/25 |
| 5,479,752 A | | 1/1996 | Menegoli | |

(Continued)

FOREIGN PATENT DOCUMENTS

DE 37 23 020 A1 1/1989

(Continued)

OTHER PUBLICATIONS

U.S. Appl. No. 10/746,546, filed Dec. 23, 2003, Haddock.

*Primary Examiner*—Carl D. Friedman
*Assistant Examiner*—Yvonne M. Horton
(74) *Attorney, Agent, or Firm*—Marsh Fischmann & Breyfogle LLP

(57) ABSTRACT

A multi-piece clamp for installation on a standing seam is disclosed. One component of the clamp is a clamp body with a clamp body slot formed therein. This slot may be mounted on a standing seam without having to slide the clamp body onto an end of the seam. Another component of the clamp is an insert(s) that may be disposed within the clamp body slot between a clamp body slot wall and the standing seam. One or more seam fasteners may be directed through the clamp body and a clamp body slot wall to secure each of the inserts within the clamp body slot by a compression of the same, and further to secure the clamp to the standing seam.

29 Claims, 14 Drawing Sheets

U.S. PATENT DOCUMENTS

| | | | | | |
|---|---|---|---|---|---|
| 5,609,326 | A | | 3/1997 | Stearns et al. | |
| 5,613,328 | A | | 3/1997 | Alley | |
| 5,715,640 | A | * | 2/1998 | Haddock | 52/545 |
| 5,732,513 | A | * | 3/1998 | Alley | 52/25 |
| 5,983,588 | A | * | 11/1999 | Haddock | 52/545 |
| 6,119,317 | A | | 9/2000 | Pfister | |
| 6,164,033 | A | * | 12/2000 | Haddock | 52/545 |
| 6,385,914 | B1 | | 5/2002 | Alley | |
| 6,688,047 | B1 | * | 2/2004 | McNichol | 52/25 |
| 6,718,718 | B1 | * | 4/2004 | Haddock | 52/545 |
| 6,725,623 | B1 | * | 4/2004 | Riddell et al. | 52/750 |
| 2002/0088196 | A1 | * | 7/2002 | Haddock | 52/543 |
| 2002/0108335 | A1 | * | 8/2002 | Haddock | 52/302.1 |

FOREIGN PATENT DOCUMENTS

| | | | |
|---|---|---|---|
| EP | 1126098 | * | 4/1998 |
| EP | 0 952 272 A1 | | 10/1999 |
| EP | 0952272 | * | 10/1999 |
| JP | 5-346055 | | 1/1991 |
| WO | WO 99/55982 | | 11/1999 |

* cited by examiner

MULTI-PIECE CLAMP FOR STANDING SEAMS

CROSS-REFERENCE TO RELATED APPLICATIONS

This patent application claims priority under 35 U.S.C. §120 to, and is a continuation of, U.S. patent application Ser. No. 09/758,805, filed Jan. 11, 2001 now abandoned, entitled "MULTI-PIECE CLAMP FOR STANDING SEAMS," and the entire disclosure of which is incorporated by reference in its entirety herein.

FIELD OF THE INVENTION

The present invention generally relates to metal surfaces that are defined by a plurality of interconnected panels that in turn define a plurality of standing seams and, more particularly, to a multi-piece clamp that has a clamp body with a clamp body slot formed therein, as well as at least one insert that is at least partially disposed within this clamp body slot and that is retained therein by at least one seam fastener when the clamp is installed on a standing seam.

BACKGROUND OF THE INVENTION

Metal panel assemblies are commonly used to define both roofing and siding surfaces on various types of buildings. These metal panel assemblies generally include a plurality of metal panels that are interconnected in a manner that defines a plurality of laterally spaced and axially or longitudinally extending standing seams. The particular way in which the opposing side-edge portions of the metal panels are configured, the particular way in which a side-edge portion of one metal panel interfaces with a side-edge portion of an adjacent metal panel, or both, defines the profile for the standing seam. Various standing seam profiles are commercially available.

FIGS. 1A–C illustrate one prior art metal panel assembly 2 of the above-described type. The panel assembly 2 includes a plurality of interconnected panels 6. Each panel 6 includes a main body or base 10 that is disposed between a pair of laterally spaced and longitudinally extending side-edge portions of the panel 6. These side-edge portions of adjacent panels 6 are interconnected in an appropriate manner to define a plurality of standing seams 14 that extend outwardly or generally away relative to the base 10 of the panels 6, that are laterally spaced, and further that are axially or longitudinally extending in the panel assembly 2 (e.g., from an eave of a roof to a peak thereof). As used herein, the "lateral" extent, dimension, or the like is at least generally in the direction of the arrow A in FIG. 1C, while the axial or longitudinal extent, dimension, or the like is at least generally in the direction of the arrow B in FIG. 1C.

Each standing seam 14 of the panel assembly 2 generally includes an extension 18 which is at least generally vertically disposed relative to the base 10 of the panels 6 or which extends outwardly from adjacent portions of the panel assembly 2. A head 22 of the standing seam 14 is disposed on an upper extreme of the extension 18. The profile of the standing seam 14 of FIGS. 1A–C is commonly referred to as a "bulb seam profile." Generally, the lateral extent of the head 22 that is represented by the dimension $d_1$ in FIG. 1B is significantly greater than the lateral extent of the extension 18 that is represented by the dimension $d_2$ in FIG. 1B. Typically the dimension $d_1$ is at least about 0.75 inches in these types of seam profiles.

Another prior art metal panel assembly is illustrated in FIGS. 2A–B in the form of a panel assembly 50. The panel assembly 50 includes a plurality of panels 54. Each panel 54 includes a base 58 that is disposed between a pair of laterally spaced and longitudinally extending side-edge portions of the panel 54. These side-edge portions of adjacent panels 54 are interconnected in an appropriate manner to define a plurality of standing seams 62 that extend outwardly from adjacent portions of the panel assembly 50, that are laterally spaced (i.e., in the same relative direction as represented by the arrow A in FIG. 1C) and that are axially or longitudinally extending (e.g., in the same relative direction as represented by the arrow B in FIG. 1C) in the panel assembly 50. Each standing seam 62 generally includes an extension 66 which is at least generally vertically disposed relative to the base 58 of the panels 54 or which extends outwardly from adjacent portions of the panel assembly 50. A head 70 is disposed on an upper extreme of the extension 66. The profile of the standing seam 62 of FIGS. 2A–B is commonly referred to as a "T-seam profile." Generally, the lateral extent of the head 70 that is represented by the dimension $d_1$ in FIG. 2B is significantly greater than the lateral extent of the extension 66 that is represented by the dimension $d_2$ in FIG. 2B. Typically the dimension $d_1$ is about one inch.

A prior art variation of the panel assembly 50 of FIGS. 2A–B is presented in FIG. 2C in the form of a panel assembly 50'. Corresponding parts of the panel assembly 50 and the panel assembly 50' are identified by the same reference numerals, although the "single prime" designation is used in the case of FIG. 2C to identify that the same is different from the configuration presented in FIGS. 2A–B. The primary distinction between the panel assembly 50 of FIGS. 2A–B and the panel assembly 50' of FIG. 2C is the configuration of the side-edge portions of the metal panels 54' and the way that the side-edge portions of adjacent metal panels 54' are interconnected to define the standing seams 62'. However, at least generally the same profile and size is realized for the head 70' of the standing seam 62' and extension 66'.

Various types of devices may be attached to metal building surfaces for any number of purposes. One prior art device is illustrated in FIG. 3 in the form of a clamp 26 that has been specifically adapted for use with the profile of the standing seam 14 of FIGS. 1A–C. The clamp 26 generally includes a unitary or one-piece clamp body 30 having a lower clamp body surface 34. A clamp body slot 38 is formed on the lower clamp body surface 34 and extends upwardly therefrom into the clamp body 30. The contour of the clamp body slot 38 at least generally approximates the contour of the head 22 and a distal portion of the extension 18 of the standing seam 14. Based upon the head 22 having a rather significantly greater lateral extent than the distal portion of the extension 18 that is disposed within the clamp body slot 38, and further in order for the clamp body slot 38 to enclose a distal portion of the extension 18, the clamp 26 must be installed on the panel assembly 2 by sliding the clamp 26 onto the standing seam 14 from an end thereof. The clamp 26 must then be slid along the axial extent of the standing seam 14 (i.e., in the direction of the arrow B in FIG. 1C) to the desired axial or longitudinal location on the standing seam 14. Once at the desired axial or longitudinal location along the standing seam 14, the clamp 26 may be fixed to the standing seam 14 by directing a seam fastener 42 through a seam fastener hole 46 in the clamp body 30. The seam fastener 42 extends within the clamp body slot 38 and engages the extension 18 against an opposing portion of the clamp body slot 38. Multiple and axially or longitudinally spaced seam fasteners 42 (i.e., spaced along the length of the clamp body slot 38 which is at least generally along the direction of the arrow B in FIG. 1C) may be used to provide for a more secure engagement of the clamp 26 onto the standing seam 14. One or more mounting cavities (e.g., threaded holes or apertures, and not shown) may be provided on various exterior surfaces of the clamp body 30 to allow various types of devices to be attached to the clamp 26 when installed on the standing seam 14, and to thereby become interconnected with the panel assembly 2. Snow retention devices, equipment frames, and walkway components are representative of what may be interconnected with the panel assembly 2 through the attachment of one and typically a plurality of clamps 26 to one or more standing seams 14 of the panel assembly 14 at one or more longitudinal or axial locations along its seams 14.

One of the primary disadvantages of the clamp 26 of FIG. 3 is the manner in which it must be installed on a standing seam. Once again, this clamp 26 must be slid onto the standing seam at one of its ends. Consider the case where the metal panel assembly having these standing seams is a roofing surface where the standing seams would typically extend from an eave of the roofing surface to a peak of the roofing surface. In the event that one or more of the clamps 26 were needed at a central location between this eave and peak, an installer would have to slide the clamp(s) 26 along the standing seam a distance of one-half of the distance between this eave and peak. The time required to complete the installation and the inconveniences associated with this installation may detract from the usage of these types of clamps. Therefore, it would be desirable to have a clamp which retains at least certain advantages associated with the construction or principles of the clamp 26 (e.g., for providing attachment capabilities to the panel assembly 2 through the clamp 26), but which eliminates the installation disadvantage of the clamp 26.

Another prior art standing seam profile and prior art clamping device are illustrated in FIG. 4. A panel assembly 300 includes a plurality of standing seams 304 (only one being shown) that axially extend from an eve of a roofing surface to a peak thereof. A clamp 308 (at least generally H-shaped in an end view) is mounted over the standing seam 304 and is secured thereto by a pair of fasteners 312 that extend through the clamp 308 and engage opposing portions of the standing seam 304. The upper portion of the clamp 308 is configured to receive a bar 316 for snow retention purposes. This bar 316 may be secured to the clamp 312 by directing a plurality of fasteners 320 through the clamp 308 and into the bar 316. An extension 324 may be attached to the bar 316 via a pair of fasteners 328 in a location that is between adjacent standing seams 304. This extension 324 extends downwardly from the bar 316.

BRIEF SUMMARY OF THE INVENTION

A first aspect of the present invention is generally a multi-piece clamp for attachment to a panel assembly that includes a plurality of standing seams. These standing seams generally correspond with the location where adjacent panels of the panel assembly are interconnected, and these seams have an axial extent or length in addition to their outward extent relative to adjacent portions of the panel assembly. The clamp of the first aspect generally includes a clamp body and at least one separate insert. The clamp body includes a clamp body slot that is formed on an exterior surface of the clamp body to allow the clamp body to be positioned over at least and typically only an axial segment of a standing seam (e.g., something less than the entire length of the standing seam) by disposing at least a distal portion of this axial segment of the standing seam within the clamp body slot. That is, this clamp body slot defines an at least generally concave receptacle on an exterior surface of the clamp body. When the clamp of the first aspect is installed on a standing seam, a first insert is located somewhere between the standing seam and a clamp body slot wall on a first side of the standing seam. A first seam fastener extends through the clamp body and into the clamp body slot in alignment with this first insert. Moving the first seam fastener relative to the clamp body and toward the first insert retains the first insert within the clamp body slot, and further retains the clamp of the first aspect on the standing seam.

Various refinements exist of the features noted in relation to the first aspect of the present invention. Further features may also be incorporated in the first aspect of the present invention as well. These refinements and additional features may exist individually or in any combination. Having the clamp of the first aspect be defined at least in part by a clamp body and at least one separate insert provides a number of benefits. Initially, this may allow the clamp of the first aspect to be installed on a standing seam without having to slide the clamp onto an end of the standing seam. This is particularly beneficial in cases where the distal extreme or head of the standing seam has a relatively wide profile in relation to a portion of the standing seam that extends outwardly from (e.g., vertically upward) adjacent portions of the panel assembly. Representative standing seam profiles of this type include a "bulbous seam" panel, a "T" seam profile, an inverted "L" seam panel, and the like. In this case, at least a portion of the first insert used by the first aspect may be disposed anywhere below the enlarged head of sorts of the standing seam to in effect almost completely enclose the enlarged head of the standing seam within a cavity that is defined at least in part by the walls of the clamp body slot, the first insert, or a combination thereof. Another benefit of the clamp of the first aspect is that it allows a single clamp body to be configured so as to be usable with inserts of various sizes, configurations, or both. The clamp of the first aspect may then be used with different standing seam profiles by using the same clamp body, and then by simply changing the insert(s).

At least one insert is disposed somewhere between the standing seam and a clamp body slot wall in the case of the first aspect, and is retained therebetween by at least one seam fastener as noted. There are a number of options in which an insert generally of the above-described type may be employed in relation to the subject first aspect. Initially, the first seam fastener may extend through the clamp body to engage the standing seam and force the standing seam into engagement with the first insert, and to then in turn force the first insert into engagement with an aligned clamp body slot wall. That is, the first insert may be disposed on an opposite side of the standing seam than the first seam fastener used by the first aspect to attach the clamp to the standing seam. Another option is for the first seam fastener to extend through the clamp body and into the clamp body slot to engage the first insert, to force the first insert into engagement with the standing seam, and to in turn force an aligned portion of the standing seam into engagement with an aligned clamp body slot wall. That is, the first insert may be disposed on the same side of the standing seam as the first seam fastener used by the first aspect to attach the clamp to the standing seam. Yet another option is for the clamp of the first aspect to include a second insert that is disposed on a second side of the standing seam, or on a side of the standing seam that is opposite that occupied by the first insert. In this case the first seam fastener could extend through the clamp body and into the clamp body slot to engage the first insert, to force the first insert into engagement with the standing seam, to in turn force the standing seam into engagement with the second insert, and to in turn force the second insert into engagement with an aligned clamp body slot wall. It may also be desirable to have the first seam fastener force the first insert into engagement with the standing seam in this manner, and further to provide a second seam fastener that extends through the clamp body and into the clamp body slot to engage the second insert and to force the same into engagement with the standing seam, preferably in direct and opposing relation to the noted first seam fastener. In those cases where a seam fastener engages an insert associated with the first aspect, it may be desirable to provide for a registration of the seam fastener on the associated insert (e.g., by providing a dimple on the insert in alignment with an associated fastener(s); by providing a groove that extends along the length of the insert such that multiple seam fasteners will interface with this same groove, but axially space locations).

The positioning of the first insert within the clamp body slot may be characterized as defining a seam profile slot, which may and preferably does at least generally approximate the contour of the enlarged head of the standing seam on which the clamp of the first aspect may be installed. Various sizes, configurations, or both of the first insert may be utilized in relation to the first aspect such that the first insert defines the desired/required amount of the seam profile slot. For instance, a "universal" clamp body could be provided as noted above, or one that was usable with at least two different types of standing seam profiles by having a sufficiently wide (in the lateral dimension) clamp body slot. Inserts with different profiles for the various different standing seam profiles could then be utilized with this same clamp body design so as to be able to modify the profile (in end view) of the seam profile slot simply by using a different insert(s).

Another way of characterizing the function of the first insert associated with the first aspect is that it provides a reduced width for that portion of the seam profile slot that is disposed below the head of the standing seam on which the clamp of the first aspect may be installed. In one embodiment, the maximum width of the seam profile slot (again, the slot defined when the first insert is disposed within the clamp body slot and which may be defined at least in part by the clamp body, the first insert, or some combination thereof) in the region thereof which includes the head of the standing seam is at least about twice the width of the seam profile slot that disposed below the head of the standing seam. This may be provided by having the first insert extend from one wall of the clamp body slot to at least generally about a lateral centerline of the clamp body slot. Preferably the first insert does not quite extend to the lateral centerline of the clamp body slot in this case, and is instead displaced therefrom by a distance that is equal to the wall thickness of the panels that define the panel assembly on which the clamp of the first aspect may be mounted.

The first insert associated with the first aspect may have a length which at least generally corresponds with a length of the clamp body slot, or which possibly extends beyond the two ends of the clamp body slot for ease of installation or otherwise. Any length may be utilized in fact for the first insert, including one that is less than the length of the clamp body slot.

At least one seam fastener may be used to retain the first insert within the clamp body slot and further to secure the clamp of the first aspect to a standing seam. Therefore, a single seam fastener could be used to retain the first insert within the clamp body slot and further to secure the clamp of the first aspect to a standing seam. Multiple seam fasteners may be utilized as well, including where these multiple seam fasteners extend through the clamp body on the same side of the standing seam but in spaced relation along the length of the clamp body slot to retain the first insert within the clamp body slot and further to secure the clamp of the first aspect to a standing seam, but at different locations that are spaced along the length of the first insert. One or more seam fasteners could also be disposed on each side of the clamp body slot to retain one or more inserts within the clamp body slot and further to secure the clamp of the first aspect on a standing seam.

At least one insert is used by the clamp of the first aspect as noted. Preferably, a single first insert is used, regardless of the number of seam fasteners that may be used to retain the first insert within the clamp body slot and further to secure the clamp of the first aspect to a standing seam. Multiple and axially aligned first inserts, however, could be utilized by the clamp of the first aspect as well (e.g., a plurality of first inserts disposed on the same side of the standing seam on which the clamp of the first aspect is installed), although such is less preferred at least from an ease of installation standpoint. In this case, at least one seam fastener would be provided for each first insert. One or more inserts may also be disposed on each side of the standing seam and at least partially within the clamp body slot, be retained therein by one or more seam fasteners that extend through the clamp body and into the clamp body slot, and that secure the clamp of the first aspect to a standing seam.

The clamp body, the first insert, or both may include structure for deforming or dimpling the standing seam at one or more discrete locations to facilitate the retention of the clamp of the first aspect on a standing seam. In one embodiment of the first aspect, the first insert includes an at least generally concave surface that is aligned with and projects toward the first seam fastener that is used to attach the clamp to a standing seam, and further that is disposed on an opposite side of the standing seam than the first seam fastener. This allows this first seam fastener to "dimple" or otherwise deform the standing seam at a discrete location when attaching the clamp to a standing seam, and which is at least believed to provide for a more secure engagement of the clamp to a standing seam (e.g., to restrict movement that is at least generally parallel with the longitudinal or axial extent of the standing seam). The concave surface on the first insert may be in the form a discrete hole or aperture that extends at least partially within the insert (e.g., circular in plan view). Another option is for this at least generally concave surface to be defined by an open groove that preferably extends the entire length of the first insert. This allows the first insert to be formed as an extrusion, and further allows the same groove to then be used to provide the dimpling effect when the clamp of the first aspect uses multiple seam fasteners that extend through the clamp body at spaced locations along the length of the clamp body slot on an opposite side of the standing seam in relation to the first insert for purposes of securing the clamp of the first aspect to a standing seam. Another option for achieving the noted "dimple" on the standing seam for cases where a seam fastener engages an insert and forces the insert into engagement with the standing seam is to include at least some type of protrusion on that surface of the insert that will interface with the standing seam, and to provide a corresponding recess on the opposite side of the standing seam (e.g., on an opposing clamp body slot wall; on an opposing insert).

Yet another option that is believed to enhance the engagement of the clamp of the first aspect to a standing seam is to allow the discrete portion of the standing seam that is deflected by a particular seam fastener to not only be directed within a cavity formed within the first insert, but to have the first insert deflect/deform in at least general alignment with and further in the direction of the forces applied by the associated seam fastener in this discrete location as well. One way in which this may be accomplished is to form an open slot on a surface of the first insert that extends within the body of the first insert and that intersects with an interiorly disposed groove. From an end view of the insert, this insert slot may be disposed relative to the more interiorly disposed insert groove such that a portion of the insert groove extends beyond each of the upper and lower extremes of the insert slot. Consider the case where the standing seam on which the clamp is installed is a vertical standing seam. The insert slot would then have a smaller vertical extent than the insert groove, and with the insert groove extending upwardly beyond an upper extreme of the insert slot and with the insert groove further also extending downwardly beyond a lower extreme of the insert slot. Extruding the first insert readily allows for use of this configuration as well, and further allows multiple seam fasteners to be utilized to attach the clamp of the first aspect to a standing seam with a single first insert at any location along the length of the first insert. In any case, this configuration defines a pair of flanges, tips, fingers, or the like for the first insert which will deflect or deform in at least general alignment with and in the direction of the forces applied by an aligned seam fastener when installing the clamp of the first aspect on a standing seam. Adjacent portions of the first insert will not deflect or at least will not deflect to the same degree as that portion of the first insert that is aligned with the subject seam fastener. As such, the deformation of the first insert provides a restriction to movement of the first insert in a direction that is at least generally parallel with an axial or longitudinal extent of the standing steam on which the clamp of the first aspect may be installed.

Additional features that may be utilized by the clamp of the first aspect of the present invention is some way to register the first insert in a predetermined position relative to the clamp body, preferably during installation. One way in which this may be done and which provides for an enhanced engagement of the first insert and the clamp body is to include one or more contours on an interface between the first insert and that portion of a clamp body slot wall that is engaged by the first insert (e.g., to provide something other than a continuous planar interface). In one embodiment, a wall of the clamp body slot that interfaces with the first insert includes a groove, and a wall of the first insert that interfaces with the clamp body slot includes a bead, rail, rib, or other protrusion that may be disposed within this groove, or vice versa. This not only registers the first insert in a predetermined position relative to the clamp body, but also increases the amount of forces which would be required to introduce relative movement between the clamp body and the first insert in a direction which is at least generally directed away from the standing seam on which the clamp of the first aspect is installed. That is, this particular way of registering the first insert in a predetermined position on a clamp body slot wall also increases the amount of resistance that the clamp of the first aspect has to a shearing-like action to which the clamp may be exposed when installed on a standing seam (e.g., a force which would tend to pivot the clamp off of the standing seam in a direction that is at least generally parallel with the axial extent of the standing seam).

A second aspect of the present invention is directed to a method for installing a clamp on a standing seam, where the clamp includes at least one insert and a separate clamp body with an open clamp body slot formed therein (i.e., such that the clamp body slot is on an exterior surface of the clamp body). The method includes moving the clamp body in a direction other than parallel with the axial extent of the standing seam to dispose at least a distal portion of at least and typically only an axial segment of the standing seam (e.g., something less than the entire length of the standing seam) within the clamp body slot. A first insert is positioned alongside the standing seam and at least partially within the clamp body slot when the clamp is attached to the standing seam such that at least part of the first insert is retained within the clamp body slot between the axial segment of the standing seam and a clamp body slot wall.

Various refinements exist of the features noted in relation to the second aspect of the present invention. Further features may also be incorporated in the second aspect of the present invention as well. These refinements and additional features may exist individually or in any combination. Consider the case where the standing seam is a vertical standing seam or where the standing seams are at least generally vertically disposed relative to adjacent portions of the panel assembly. The movement of the clamp body of the second aspect to install the same may then be characterized as being in an at least generally downward direction to dispose at least the upper extreme of an axial segment of the standing seam within the clamp body slot. In the case where the clamp body is installed in this manner, the first insert may thereafter be disposed within the clamp body slot by moving the first insert in an at least generally upward direction. The second aspect of the present invention also contemplates that the first insert may be positioned against or at least proximate to the standing seam when the clamp body is mounted on the standing seam in the above-described manner.

The manner of attachment of the clamp of the second aspect to the standing seam may include placing the first insert in compression. For instance, this may be done by directing a seam fastener through the clamp body and into the clamp body slot, forcing an aligned portion of the standing seam against the first insert, and in turn forcing the first insert against a portion of the clamp body slot wall that is disposed in opposing relation to the seam fastener. Another option is to direct a seam fastener through the clamp body and into the clamp body slot, to engage the seam fastener against an aligned portion of the first insert, and to force the first insert into engagement with the standing seam. This may direct the standing seam into engagement with an aligned portion of a clamp body slot wall that is disposed in opposing relation to the fastener, or may direct the standing seam into engagement with a second insert that is disposed on the opposite side of the standing seam in relation to the first insert, that in turn may direct the second insert into engagement with an aligned portion of a clamp body slot wall that is disposed in opposing relation to the second insert.

This attachment of the clamp of the second aspect may also include deforming at least part of the standing seam at one or more discrete locations to enhance the interconnection between the clamp of the second aspect and the standing seam. Further enhancement of the interconnection of the clamp to the standing seam may be realized by limiting relative movement between the clamp body and the first insert in a direction which is at least generally directed away from the standing seam (e.g., in a direction which would tend to "pull" the clamp off of the standing seam, such as by a pivoting like action within a plane that includes the axial extent of the standing seam). One way in which this may be done is to register the first insert in a predetermined position relative to the clamp body, and to use the interfacing structure of the clamp body and the first insert which provides this registration to also provide resistance to the noted relative movement between the clamp body and the first insert.

Resistance to movement of the clamp in accordance with the second aspect that is at least generally parallel with the axial extent of the standing seam further may be provided by deforming or deflecting the first insert at a discrete location when attaching the clamp to the standing seam in accordance with the second aspect. Consider the case where a seam fastener is directed through the clamp body to engage the standing seam to force the same against the first insert, to in turn force the same against a wall of the clamp body slot or an opposing insert to provide for the attachment of the clamp to the standing seam. The first insert may include an insert slot that is defined by a pair of spaced cantilevered flange members or the like which extend the entire length of the insert. These flange members may designed to deflect in at least general alignment with and in the direction of the forces applied to the standing seam by a corresponding seam fastener when applied in the above-noted manner. Adjacent portions of the flange members will not deflect, or at least to not the same degree as those portions that are aligned with the subject seam fastener. This provides resistance to movement of the clamp in a direction which is at least generally parallel with the longitudinal or axial extent of the standing seam on which the clamp may be installed in accordance with the second aspect.

DETAILED DESCRIPTION OF THE INVENTION

Figure 1B:
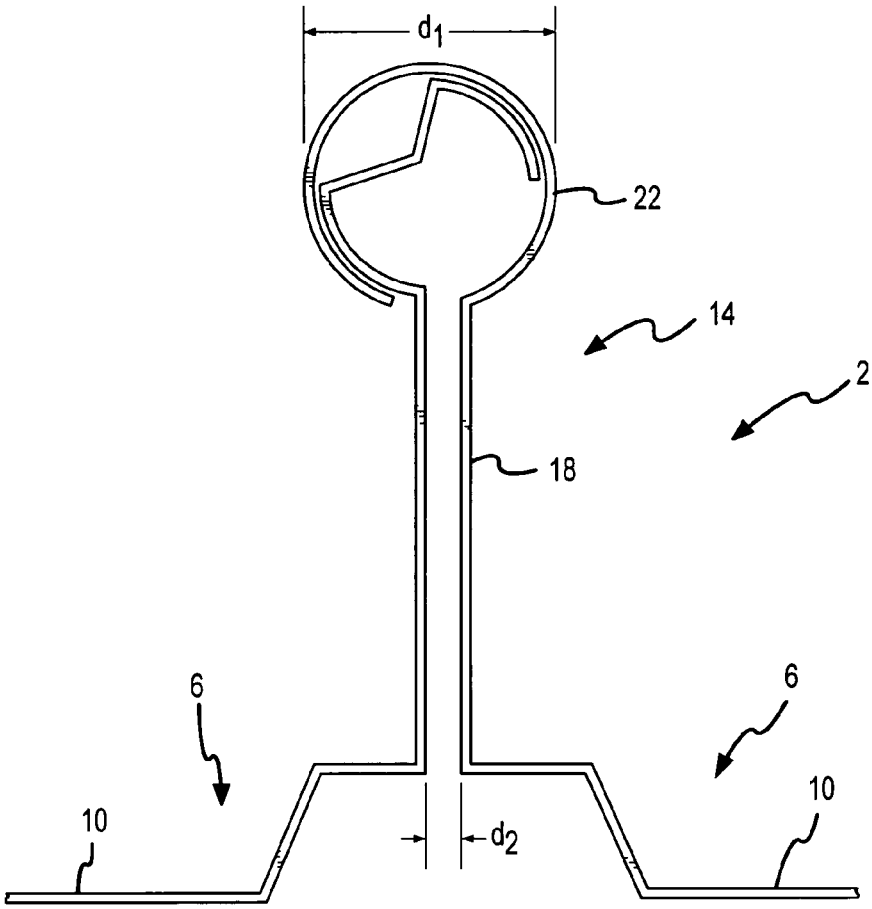
FIG.1B (PRIOR ART)
FIG. 1B is an enlarged end view of the standing seam profile used by the panel assembly of FIG. 1A.
Figure 1A:
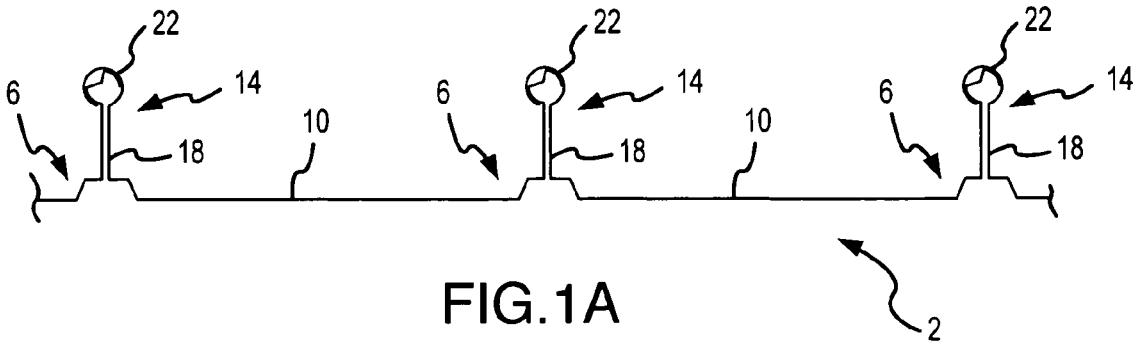
FIG.1A (PRIOR ART)
FIG. 1A is an end view of a prior art panel assembly.
Figure 1C:
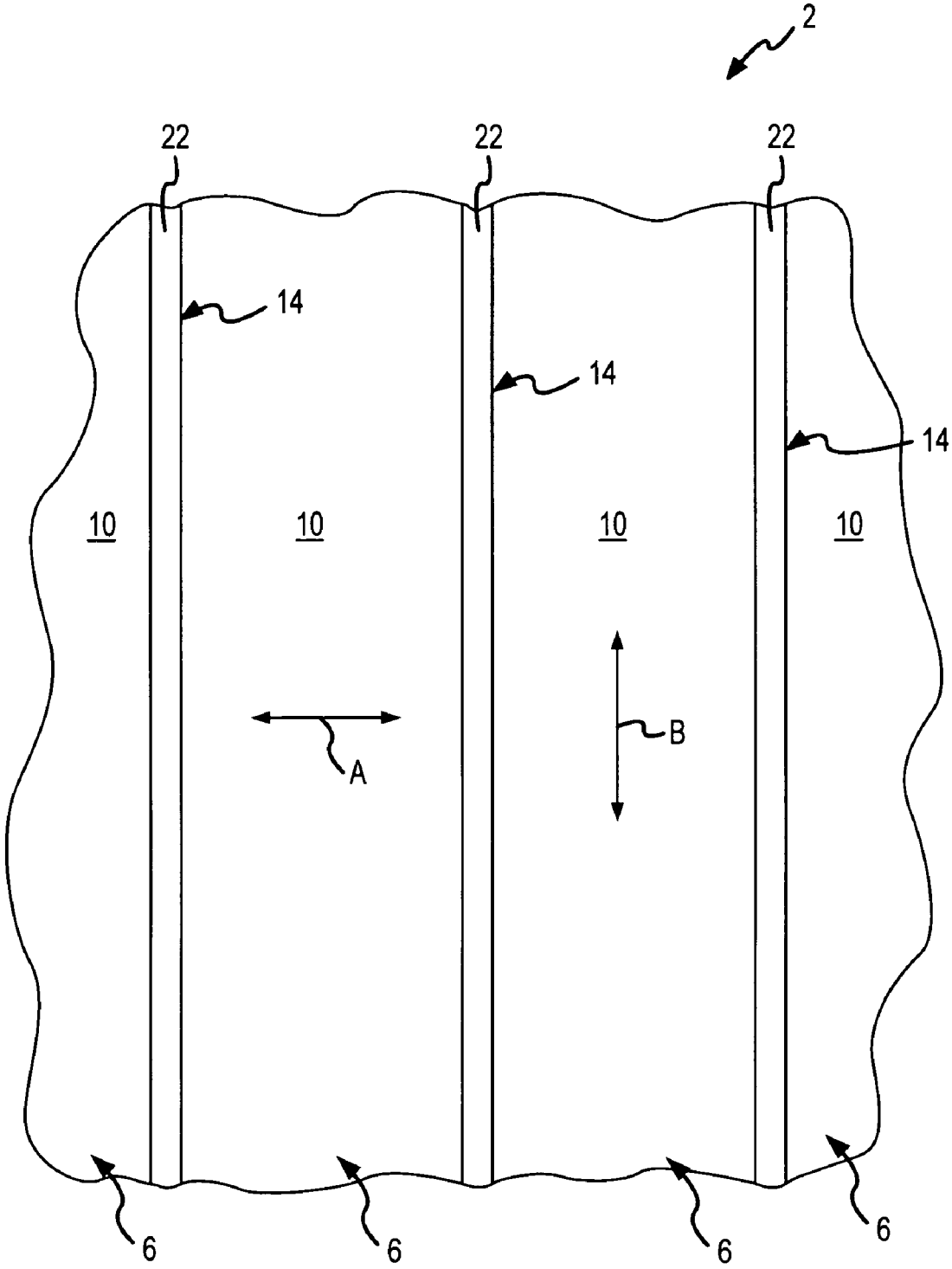
FIG.1C (PRIOR ART)
FIG. 1C is a plan view of the panel assembly of FIG. 1A.
Figure 5A:
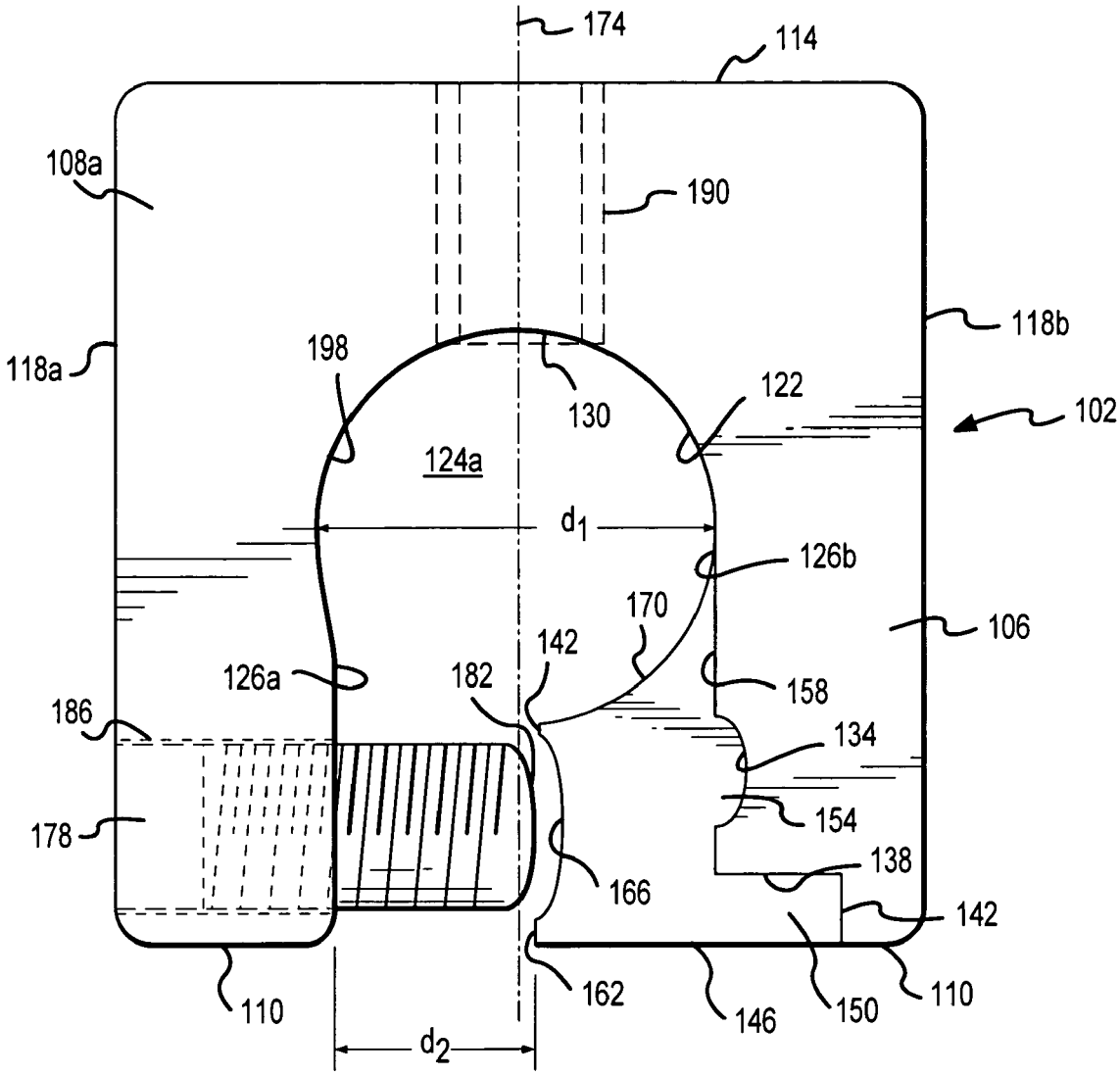
FIG. 5A is an end view of one embodiment of a two-piece clamp for use with the type of standing seam profile used by the panel assembly of FIGS. 1A–C.
Figure 5B:
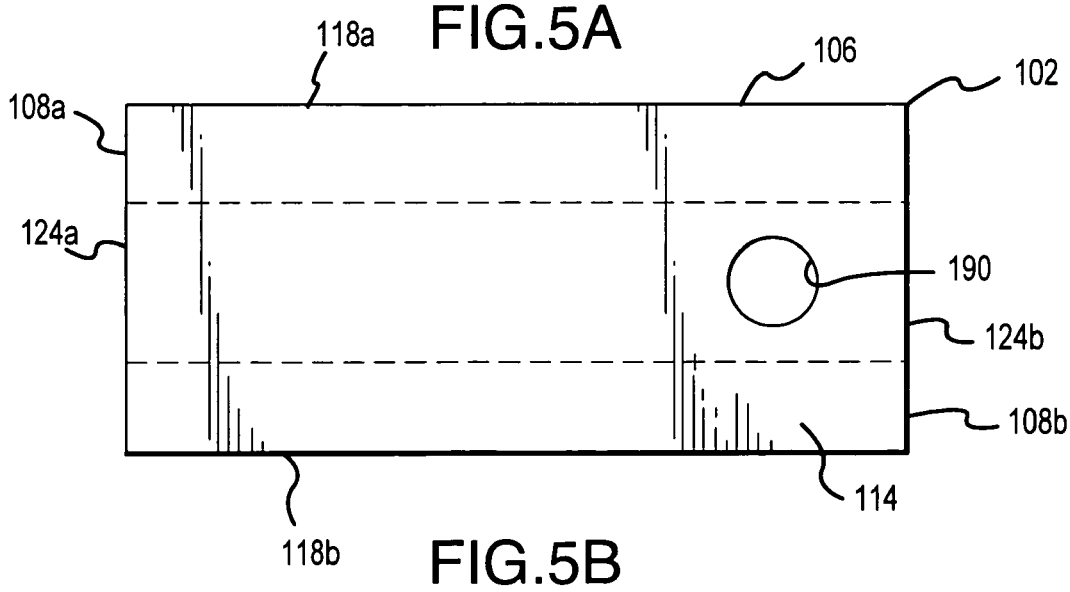
FIG. 5B is a top view of the two-piece clamp of FIG. 5A.
Figure 5C:
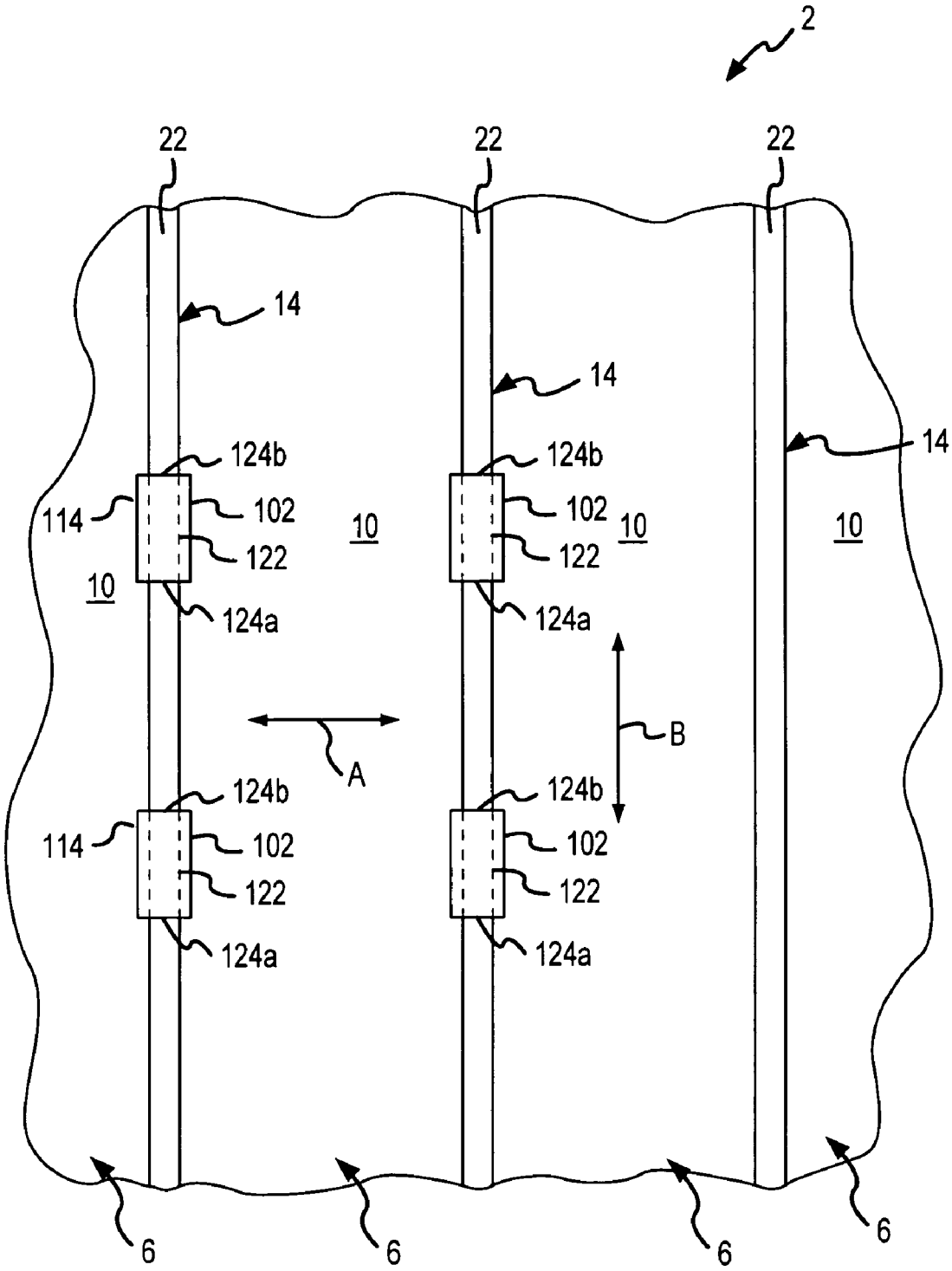
FIG. 5C is a top, plan view of a plurality of the clamps of FIGS. 5A–B installed on the panel assembly of FIGS. 1A–C.

The present invention will now be described in relation to the accompanying drawings which at least assist in illustrating its various pertinent features. FIGS. 5A–C present a clamp 102 that may be used with a standing seam profile of at least generally the type used by the panel assembly 2 of FIGS. 1A–C. For convenience, the clamp 102 will be described in relation to the standing seam 14. The clamp 102 generally includes a unitary or one-piece clamp body 106. Preferably the clamp body 106 is an extrusion of a material that is appropriate for the desired application of the clamp 102, such as aluminum, brass, or zinc. Other manufacturing techniques could also be utilized for making the clamp body 106, such as casting or machining. Extruding the clamp body 106 provides a number of advantages, including ease of manufacture and structural strength.

The clamp body 106 is defined by a pair of clamp body ends or end surfaces 108*a*, 108*b* that are longitudinally spaced (i.e., spaced in the direction of the arrow B in FIG. 5C), a pair of laterally spaced (i.e., spaced in the direction of the arrow A in FIG. 5C) and at least generally longitudinally extending clamp body side surfaces 118*a*, 118*b*, a clamp body upper surface 114, and a clamp body lower surface 110. Each of the clamp body surfaces 108, 118, 114, and 110 are at least generally planar in the illustrated embodiment, with the end surfaces 108*a*, 108 further being at least generally parallel to each other and also at least generally perpendicular with the clamp body upper surface 114, the clamp body lower surface 110, and the clamp body side surfaces 118; with the clamp body upper surface 114 and clamp body lower surface 110 further being at least generally parallel to each other and also at least generally perpendicular with both the clamp body side surfaces 118 and end surfaces 108; and with the clamp body side surfaces 118*a*, 118*b* further being at least generally parallel to each other and at least generally perpendicular to the clamp body end surfaces 108, the clamp body upper surface 114, and the clamp body lower surface 110. Other profiles and orientations could be utilized for one or more of the clamp body surfaces 108, 118, 114, and 110, although having one or more of these surfaces 108, 118, 114, and 110 in an at least generally planar configuration provides one or more advantages for mounting various structures to the clamp 102.

An open or concave clamp body slot 122 having a pair of longitudinally spaced open ends 124*a*, 124*b* on the container body end surfaces 108*a*, 108*b* is formed on the clamp body lower surface 110 and extends at least generally toward, but not to, the clamp body upper surface 114. "Open" means that the clamp body slot 122 is on an exterior surface of the clamp body 106 and extends therewithin. The clamp body slot 122 is defined by a pair of laterally spaced and at least generally longitudinally extending slot sidewalls 126*a*, 126*b* that extend between the open ends 124*a* and 124*b* of the clamp body slot 122 and that are disposed in at least generally parallel relation. The slot sidewalls 126*a*, 126*b*, at least in the upper portion of the clamp body slot 122, are at least generally centrally disposed relative to a lateral central reference axis 174 of the clamp body slot 122. The clamp body slot 122 further includes a slot base 130 that also extends at least generally longitudinally between the open ends 124*a*, 124*b* of the clamp body slot 122, and that further extends at least generally laterally between the slot sidewalls 126*a*, 126*b*. A seam fastener hole 186 (e.g., threaded) extends from the clamp body side surface 118*a* to the slot sidewall 126*a* for receiving a seam fastener 178 (e.g., a threaded set screw or the like). A single seam fastener hole 186 could be utilized to attach the clamp 102 to the standing seam 14. Multiple seam fastener holes 186 may also be utilized to attach the clamp 102 to the standing seam 14 and that would then be longitudinally spaced along the length or longitudinal extent of the clamp body 106 (e.g., in the direction of the arrow B in FIG. 5C). One or more mounting cavities 190 may be included on one more of the clamp body upper surface 114, the clamp body side surface 118*a*, and the clamp body side surface 118*b* and extend within the clamp body 106 to allow for attachment of various structures/devices to the clamp 102. Typically each mounting cavity 190 will be in the form of a threaded hole or a pilot hole for a thread-cutting fastener such that various structures/devices may be attached to the clamp 102 by threading an appropriate bolt or other fastener into the desired/required mounting cavity 190.

The clamp 102 further includes a unitary or one-piece insert 142 that is disposed against at least a portion of the clamp body 106 that defines the clamp body slot 122, with at least part of the insert 142 being disposed in at least generally opposing relation to and in axial alignment with the seam fastener hole(s) 186. In the illustrated embodiment, the insert 142 interfaces with a lower portion of the slot sidewall 126*b*. However, the insert 142 could be configured to interface with any appropriate amount of the clamp body 106 that defines the clamp body slot 122. For instance, the insert 142 could interface with all or any portion of the slot sidewall 126*b*, the slot base 130, the slot sidewall 126*a*, or any combination thereof, and further in any configuration. What is of importance is that the disposition of the insert 142 within the clamp body slot 122 defines a seam profile slot 198. Although not required, preferably this seam profile slot 198 at least generally approximates the profile of the head 122 of the standing seam 14 on which the clamp 102 is installed. As such, it should be appreciated that changing the profile of the surfaces 162 and 170 of the insert 142 in the view illustrated in FIG. 5A, the size or configuration of the insert 142, the profile and/or location of the interface between the insert 142 and the clamp body 106, or any combination thereof will change the shape and/or size of the seam profile slot 198.

Preferably the insert 142 is an extrusion of a material that is appropriate for the desired application of the clamp 102, such as aluminum, brass, or zinc. Other manufacturing techniques could also be utilized for making the insert 142, such as casting or machining. Extruding the insert 142 provides a number of advantages, including ease of manufacture and structural strength. The insert 142 may also be of any appropriate length, including less than the length of the clamp body slot 122, the same as the clamp body slot 122, and greater than the clamp body slot 122. Multiple inserts 142 could also be utilized by the clamp 102 on the same side of the standing seam 14 on which the clamp 102 is to be installed, such as having a separate insert 142 for each seam fastener 178 that is used by the clamp 102 to attach the same to the standing seam 14. However, preferably the clamp 102 uses only a single insert 142, regardless of the number of seam fasteners 178 that are used by the clamp 102 for attachment to the standing seam 14.

Generally, the separate insert 142 allows the clamp 102 to be installed on a standing seam 14 without having to slide the clamp 102 onto a free end of the standing seam 14 and then along the axial extent of the standing seam 14 to the desired axial position. This is realized by configuring the insert 142 and/or the clamp body slot 122 so that the width of the seam profile slot 198 (again defined when the insert 142 is disposed in the clamp body slot 122) in the region thereof that will include the head 22 of the standing seam 14 is greater, and more preferably significantly greater, than the width of the seam profile slot 198 that would be disposed below the head 22 of the standing seam 14. In one embodiment, the maximum width of the seam profile slot 198 in that portion thereof which receives the head 22 of the standing seam 14 (represented by the dimension $d_1$ in FIG. 5A) is generally about twice as large as the width of the seam profile slot 198 that is disposed below the head 22 of the standing seam 14 (represented by the dimension $d_2$ in FIG. 5A).

The insert 142 generally includes a seam extension interface surface 162 that interfaces with the extension 18 of the standing seam 14 (FIGS. 1A–B) on which the clamp 102 is installed. The vertical extent of the insert 142 and/or clamp body 106 may be of any size such that the insert 142 may interface with the extension 18 along any portion thereof (e.g., the insert 142, the clamp body 106, or both could be configured to enclose the entire vertical extent of the standing seam 14 or any portion thereof). Initially, the seam extension interface surface 162 of the insert 142 preferably does not extend from the second slot sidewall 126*b* beyond the lateral central reference axis 174 of the clamp body slot 122. In one embodiment, the portion of the seam extension interface surface 162 that is closest to the lateral central reference axis 174 is spaced therefrom a distance that is at least generally equal to the wall thickness of one of the panels 6 of the panel assembly 2 on which the clamp 102 is installed.

A portion of the extension 18 of the axial segment of the standing seam 14 on which the clamp 102 is installed is retained between the head 22 of the seam fastener 178 and the aligned portion of the seam extension interface surface 162 of the insert 142. In this regard and after the clamp 102 has been positioned on the standing seam 14 in a manner which will be described in more detail below, the seam fastener 178 is advanced through the clamp body 106 and past the slot sidewall 126*a* to engage an aligned portion of the extension 18 of the standing seam 14 and move the same into forcible engagement with an aligned portion of the insert 142. Retention of the clamp 102 on the standing seam 14 may be enhanced by including a recess on at least that portion of the seam extension interface surface 162 of the insert 142 that is aligned with the seam fastener 178 to "dimple" the engaged portion of the extension 18 in a discrete area corresponding with a tip 182 of the fastener 178. In the illustrated embodiment where the insert 142 is an extrusion, this recess may be provided by a seam interface groove 166 that extends the entire length of the insert 142 and which may be readily formed in the extrusion process. Another less desirable option would be to extrude, machine, or cast the insert 142 to have a planar seam extension interface surface 162, and to thereafter machine an appropriate recess into this surface at least in axial alignment with each fastener 178 that is used by the clamp 102 to secure the same to the standing seam 14. In one embodiment, the depth of the portion of the seam extension interface surface 162 of the insert 162 that is aligned with the seam fastener 178 is recessed a distance at least generally similar to the radius of the tip 182 of the seam fastener 178. That is, each seam fastener 178 used to attach the clamp 102 to the standing seam 14 preferably has a convex or rounded tip 182 so as to reduce the potential for piercing or marring the standing seam 14. Preferably, the corresponding recess formed on the seam extension interface surface 162 of the insert 142 at least generally matches this profile in at least in one dimension (e.g., the radius which defines the groove 166 preferably is at least generally the same as the radius which defines the tip 182 of the seam fastener 178).

Movement of each seam fastener 178 in the above-noted manner not only secures the extension 18 of the standing seam 14 between the fastener 178 and the insert 142, but it also forcibly engages the insert 142 against the slot sidewall 126*b* of the clamp body 106. Certain features of the clamp 102 enhance this interface between the insert 142 and the clamp body 106. In this regard, the slot sidewall 126*b* generally includes a clamp body registration structure 134 (e.g., a groove) that preferably extends the full length of the clamp body 106 or the entire length between the clamp body end surfaces 108*a*, 108*b* in the illustrated embodiment (or stated another way at least generally the entire length of the clamp body slot 122), while a sidewall interface surface 158 of the insert 142 includes an insert registration structure 154 (e.g., a rail, rib, or other protrusion) that preferably extends the full length of the insert 142 and that appropriately interfaces with the clamp body registration structure 134. The registration structures illustrated for the insert 142 and the clamp body 106 that are illustrated in FIG. 5A could be reversed. Other registering structures could be used and of any appropriate size/configuration as well (e.g., one or more "pin/button" and "hole/detent" pairs). In any case, this not only registers the insert 142 in a predetermined position relative to the slot sidewall 126*b* of the clamp body 106, but it also reduces the potential for the insert 142 and clamp body 106 becoming disengaged during use of the clamp 102. Consider the case where a force is applied to the clamp 102 after being installed on the standing seam 14 and in a direction which would tend to pull the clamp 102 off of the standing seam 14 (e.g., by a pivoting-like action in the general direction of the longitudinal extent of the standing seam 14). An exclusively planar and continuous interface between the slot sidewall 126*b* and the insert 142 (not shown) would allow for a sliding motion between the slot sidewall 126*b* and the insert 142 upon these forces exceeding a certain magnitude. Significantly greater forces of this type would be required to realize relative movement between the slot sidewall 126*b* of the clamp body 106 and the sidewall interface surface 158 of the insert 142 when using the clamp body registration structure 134 and insert registration structure 154 or other appropriate types of registering structures.

The insert 142 also includes an insert lower surface 146 that may be coplanar with the clamp body lower surface 110. Part of this insert lower surface 146 is defined by a leg 150 of the insert 142 that preferably extends at least generally along the entire length of the insert 142. This leg 150 may facilitate the installation of the insert 142 into the lower portion of the clamp body slot 122 when installing the clamp 102 on a standing seam 14 by providing a convenient "handle" of sorts for the installer. This leg 150 is disposed within a notch 138 that is formed in the clamp body lower surface 110 of the clamp body 106 alongside the lower extreme of the slot sidewall 126*b*, and that preferably at least generally extends the entire length of the clamp body slot 122. The interface between the leg 150 and the notch 138 further serves to register the insert 142 in a predetermined position relative to the clamp body 106. This feature may be used by any of the inserts for multi-piece clamps described herein.

The insert 142 further includes a seam head interface surface 170 that projects at least generally toward the slot base 130 of the clamp body slot 122. Generally, an upper portion of the slot sidewall 126*a*, the slot base 130, an upper portion of the slot sidewall 126*b*, and the seam head interface surface 170 of the insert 142 collectively define a cavity in which the head 22 of the standing seam 14 may be disposed. Preferably, the upper portion of the slot sidewall 126*a*, the slot base 130, the upper portion of the slot sidewall 126*b*, and the seam head interface surface 170 of the insert 142 at least generally approximate the contour of the corresponding portion of the head 22 of the standing seam 14 on which the clamp 102 is installed. Once again, the portion of the insert 142 that defines at least part of the seam profile slot 198 may be of any configuration and may define any desired/required portion of the seam profile slot 198.

Figure 5D:
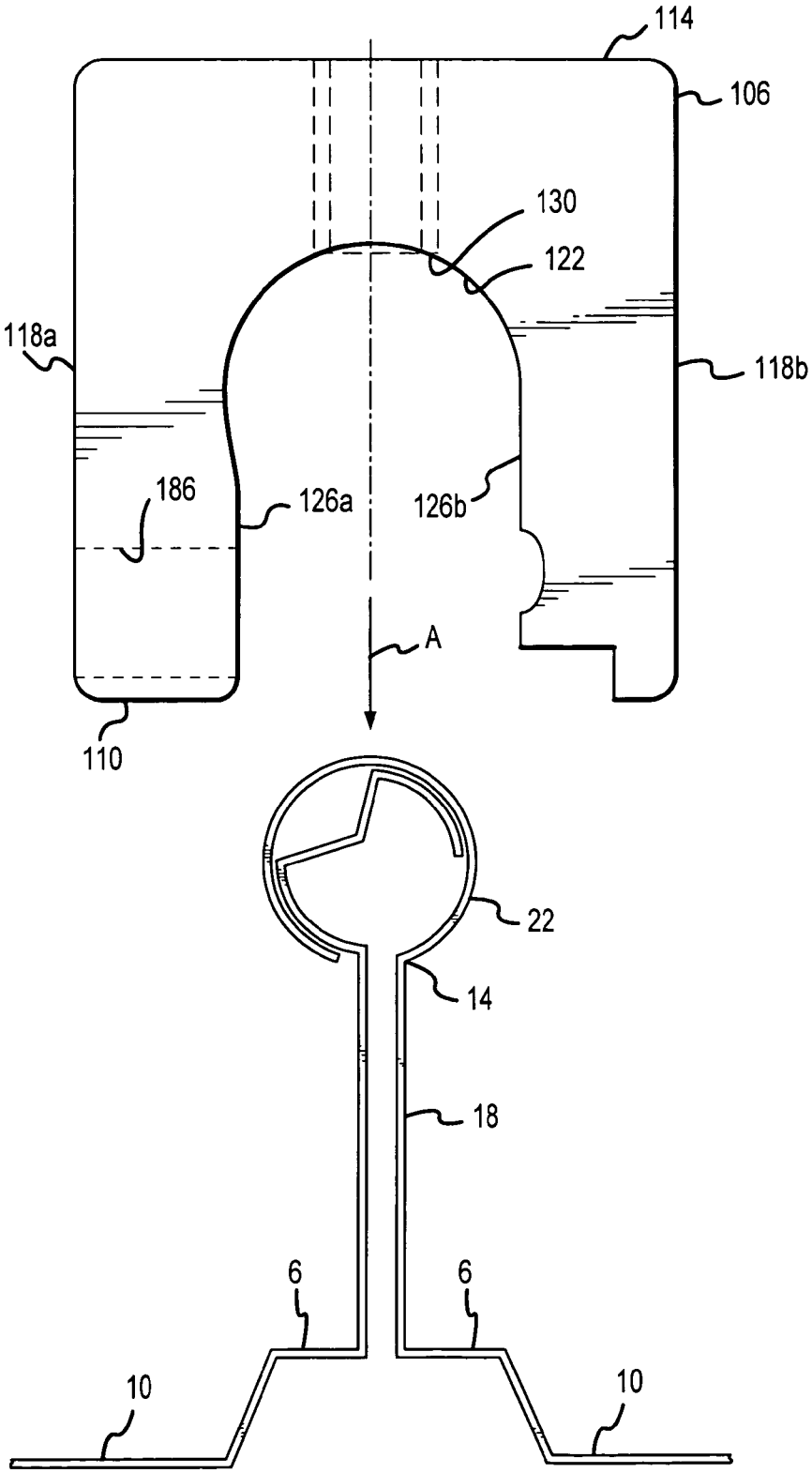
FIG. 5D is an enlarged end view illustrating the installation of the clamp body of FIGS. 5A–B onto a standing seam of the panel assembly of FIGS. 1A–C.

Based upon the foregoing description of the clamp 102 and its construction, it should be appreciated that the clamp 102 alleviates the need for sliding the clamp 102 onto one of the ends of the standing seam 14 in order to install the same. Installation of the clamp 102 instead may be accomplished in the following manner and in reference to FIG. 5D, as well as FIGS. 1A–C and 5A–C. Each seam fastener 178 of the clamp 102 initially should be disposed a sufficient distance from the slot sidewall 126*b* to allow for receipt of the insert 142 and the extension 18 of the standing seam 14 between the insert 142 and the tip 182 of the seam fastener(s) 178. The seam fastener(s) 178 may in fact be in a recessed position relative to the slot sidewall 126*a* at the start of the installation, or in fact may be entirely removed from the seam fastener hole 186 as illustrated in FIG. 5D although this is not preferred. In any case, the clamp body 106 will be disposed vertically above or beyond the head 22 of the standing seam 14 such that the axial extent of the clamp body slot 122 is at least somewhat axially aligned with the longitudinal or axial extent of the standing seam 14 as illustrated in FIG. 5D. The clamp body 106 is then moved in an at least generally downward direction in the illustrated embodiment (represented by the arrow A in FIG. 5D) to dispose the clamp body 106 over the head 22 of a distal portion of the standing seam 14 and within the clamp body slot 122. One could also characterize this motion as advancing the clamp body 106 in a direction which is at least generally perpendicular to an uppermost surface of the head 22 of the standing seam 14, as advancing the clamp body 106 in a direction which is least generally parallel with the vertical extent of the extension 18 of the standing seam 14 and in alignment therewith, or as advancing the clamp body 106 in a direction which is at least generally coplanar with an axial extent of the standing seam 14. The clamp 102 could also be installed on a horizontally disposed head of a standing seam in the same general manner as noted herein, such that the clamp body slot 122 would than be at least generally horizontally disposed.

After the clamp body 106 has assumed the above-noted position on the standing seam 14 where the slot base 130 will then typically be disposed on the distal or extreme portion of the head 22 of the standing seam 14 or at least thereabouts, the installer may grasp the insert 142 (e.g., by the leg 150), position the insert 142 under the clamp body 106, and then move the same in an at least generally upward direction (opposite the direction illustrated by the arrow A in FIG. 5D) to dispose the insert 142 at least partially within the clamp body slot 122 and at least generally against the second slot sidewall 126*b*. Preferably the position of the insert 142 is registered relative to the slot sidewall 126*b* by disposing the insert registration structure 154 in interfacing relation with the clamp body registration structure 134 on the second slot sidewall 126*b*, by disposing the leg 150 on the insert 142 within the notch 138 on the clamp body 106, or both. Thereafter the installer may the advance each seam fastener 178 toward a corresponding portion of the insert 142 to securely retain a portion of the extension 18 between the tip 182 and the seam extension interface surface 162 of the insert 142 that is axially aligned with the associated seam fastener 178. Again, preferably this action creates a "dimple" on the extension 18 of the standing seam 14 to provide for a more secure engagement of the clamp 102 on the standing seam 14. The same forces that retain the extension 18 of the standing seam 14 between the seam fastener 178 and the insert 142 also forcibly engages the insert 142 against the clamp body 106 to secure the assemblage of the clamp 102. The order in which the clamp body 106 and the insert 142 are installed may be reversed in that the installer could hold the insert 142 against or at least proximate to the extension 18, and then move the clamp body 106 onto the head 22 of the standing seam 14 in the above-noted manner. In any case, the configuration of the clamp 102 and manner of installing the same on the standing seam 14 places the insert 142 entirely in compression when the clamp 102 is in the installed position on the standing seam 14. Each seam fastener 178 that is used to assemble the clamp 102, to secure the clamp 102 to the standing seam 14, or both, is also entirely in compression, and further is preferably disposed below the head 22 of the standing seam 14.

Figure 6A:
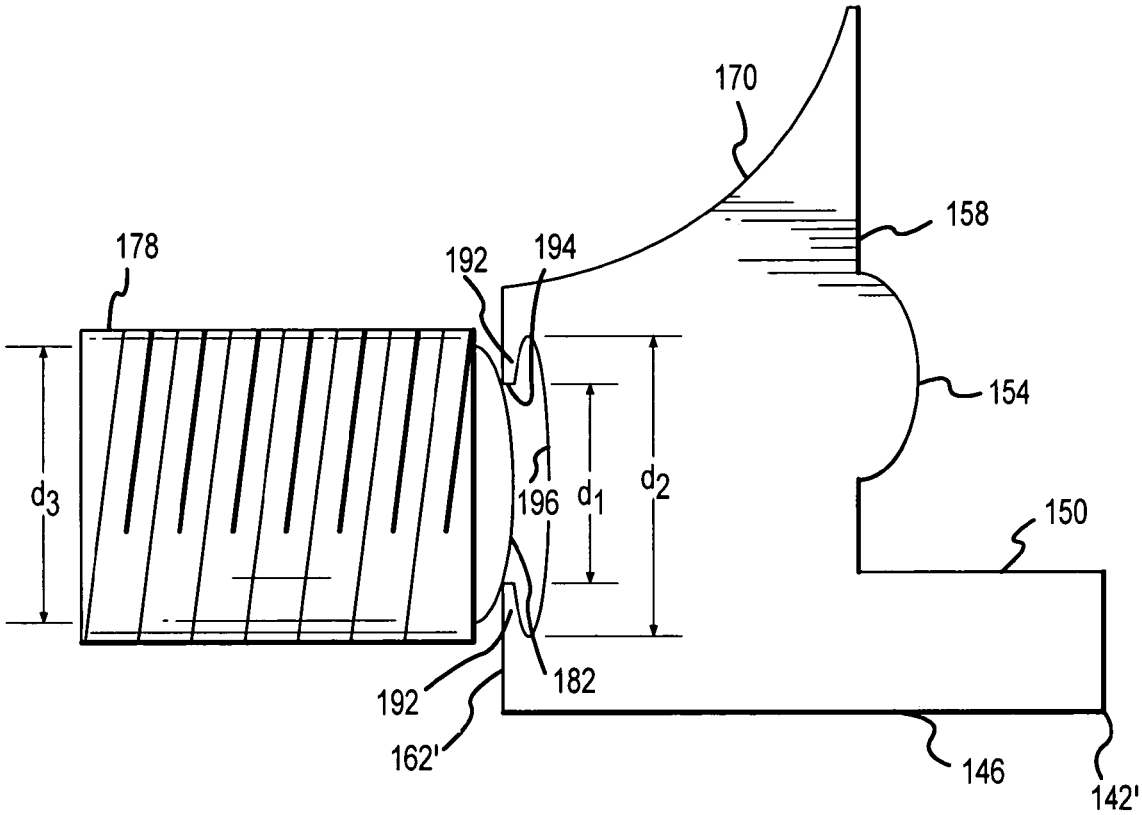
FIG. 6A is an enlarged end view of an alternate configuration for an insert of a multi-piece clamp.
Figure 6B:
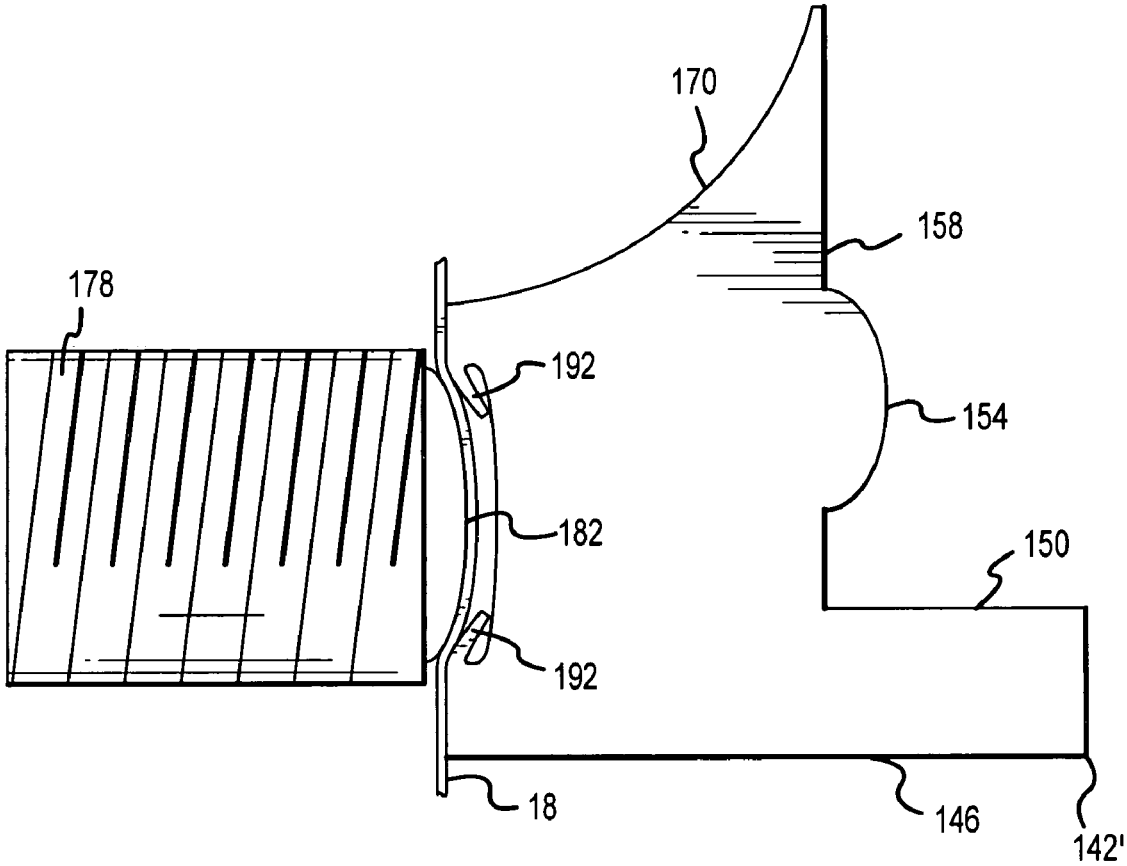
FIG. 6B is an end view of the insert of FIG. 6A, with the seam fastener being in the installed position on a standing seam of the panel assembly of FIGS. 1A–C.
Figure 6C:
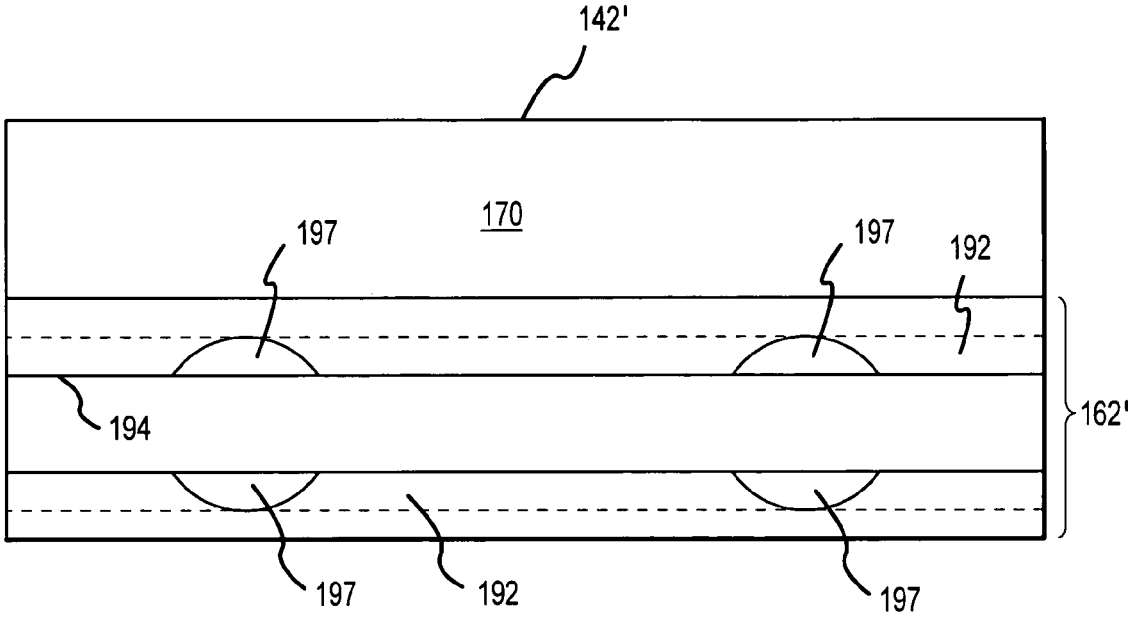
FIG. 6C is a side view of the insert of FIG. 6A after having been installed on and thereafter being removed from a standing seam.

An alternative and currently preferred configuration for the insert 142 of the clamp 102 of FIGS. 5A–C is illustrated in FIGS. 6A–C in the form of an insert 142'. This same insert 142' may in fact be adapted for use by any of the multi-piece clamps described herein. Components of the insert 142' that correspond with components of the insert 142 of FIGS. 5A–B are identified with similar reference numerals. A "single prime" designation is used to identify those particular parts or surfaces which differ in at least some respect. The primary distinction between the insert 142 of FIGS. 5A–B and the insert 142' of FIGS. 6A–C is the configuration of the seam extension interface surface 162'. Generally, the seam extension interface surface 162' includes a recess that extends within the insert 142' to a larger recess. This sequential recess arrangement is preferably provided at least in alignment with each seam fastener 178 that is used to install a clamp 102 that uses the clamp body 106 and the insert 142'. In the case where the insert 142' is an extrusion, the noted recesses are preferably in the form of an open seam interface slot 194 and a larger seam interface groove 196 that will both then extend at least generally the entire length of the insert 142'. "Larger" in the context of the slot 194 and groove 196 means at least that the vertical extent $d_1$ of the seam interface slot 194 is smaller than the vertical extent $d_2$ of the seam interface groove 196 that is disposed "behind" the seam interface slot 194 and as illustrated in FIGS. 6A–B. Preferably, the seam interface groove 196 extends beyond the seam interface slot 194 in a direction that is at least generally away from the insert lower surface 146, and also extends beyond the seam interface slot 194 in a direction that is at least generally toward the insert lower surface 146. More preferably, the vertical extent of the slot 194 is centrally disposed relative to the vertical extent of the groove 196. In any case, this arrangement defines a pair of spaced cantilevered flanges 192, protrusions, extensions or the like that are in effect a pair of oppositely disposed cantilevers. When a seam fastener 178 is engaged to install the clamp 102, the tip 182 of the seam fastener 178 will not only dimple the interfacing portion of the extension 18 of the standing seam 14, but it will also the deflect or deform the insert 142' in at least the general manner illustrated in FIGS. 6B–C. That is, both of the flanges 192 will be deflected or deformed toward the wall of the insert 142' that defines the groove 196 over an area which at least generally corresponds with the diameter of the tip 182 of the seam fastener 178. This is represented in FIG. 6C by dimples 197. FIG. 6C illustrates the case where the clamp 102 uses two seam fasteners 178 for attachment to the standing seam 14. Those portions of the flanges 192 that are not axially aligned with a seam fastener 178 will not deflect or deform, or at least will not deflect or deform to the same extent as those portions that are aligned with a seam fastener 178. This provides the clamp 102 with a resistance to movement in a direction that is at least generally parallel with an axial extent of the standing seam 14 on which the clamp 102 is installed, as well as any other relative movement between the clamp 102 and the standing seam 14 for that matter.

Figure 2C:
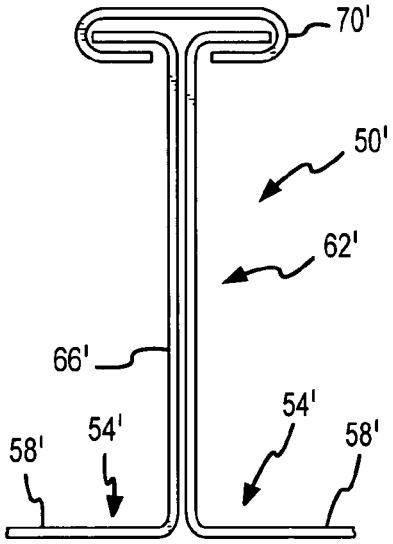
FIG.2C (PRIOR ART)
FIG. 2C is an enlarged end view of an alternative way of interconnecting adjacent side-edge portions of panels to realize the seam profile used by the panel assembly of FIGS. 2A–B.
Figure 2B:
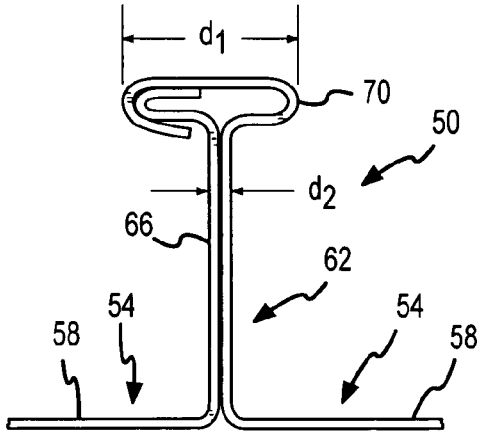
FIG.2B (PRIOR ART)
FIG. 2B is an enlarged end view of the seam profile used by the panel assembly of FIG. 2A.
Figure 2A:
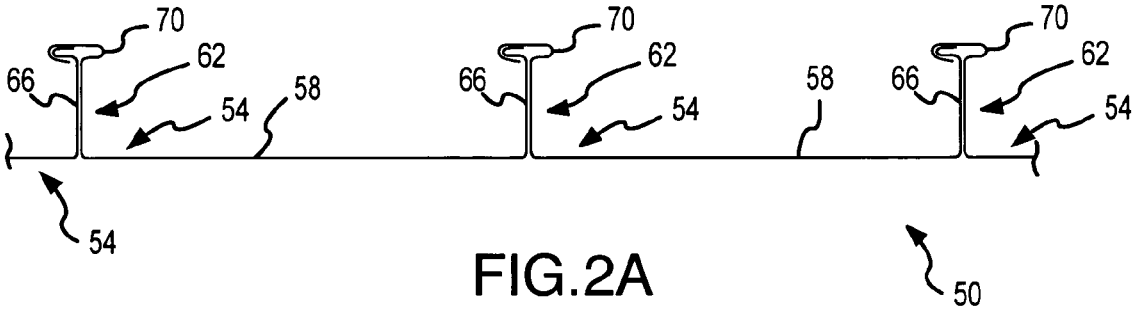
FIG.2A (PRIOR ART)
FIG. 2A is an end view of another prior art panel assembly.
Figure 3:
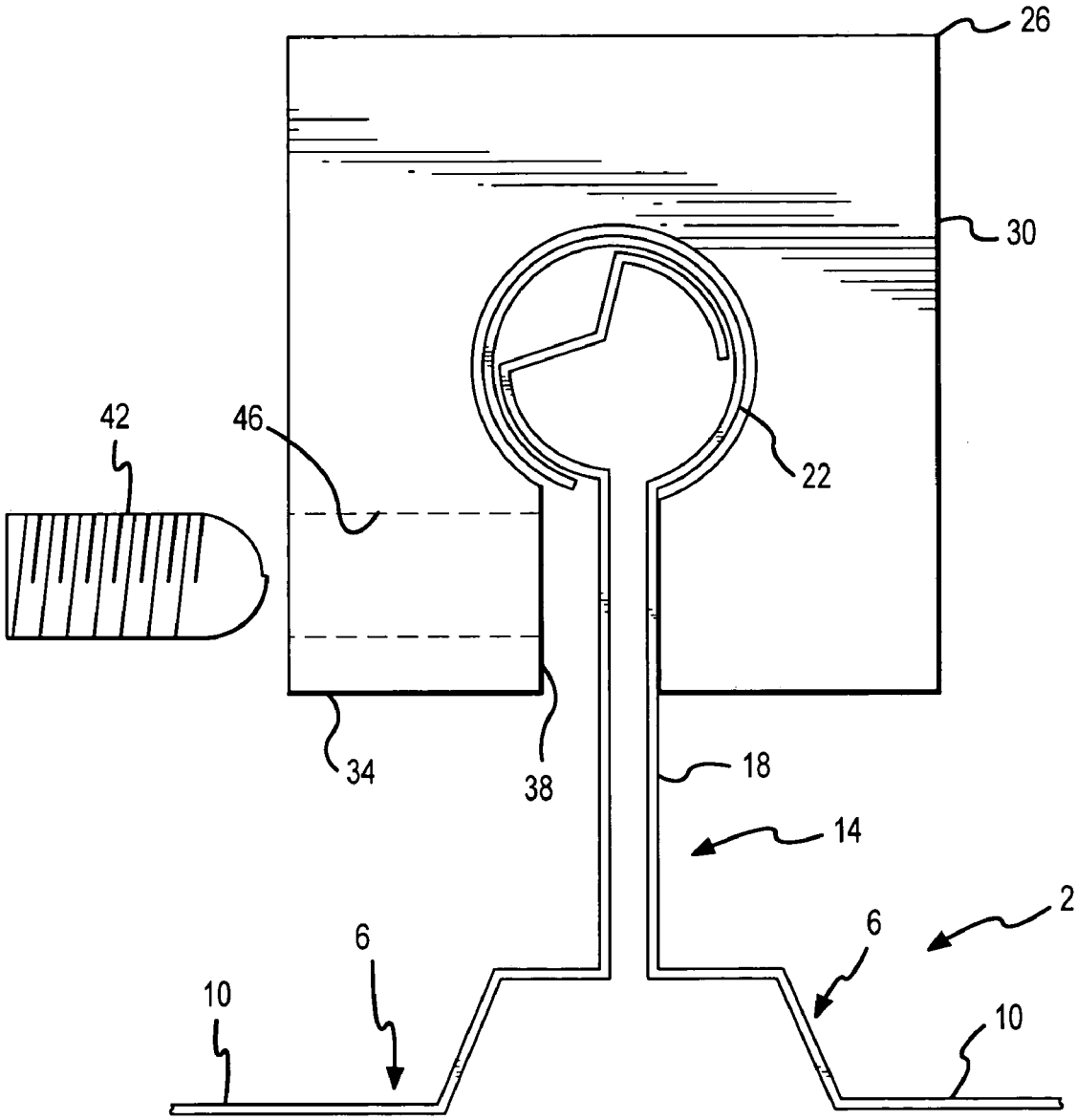
FIG.3 (PRIOR ART)
FIG. 3 is an end view of a prior art clamp that has been adapted for use with the standing seam profile used by the prior art panel assembly of FIGS. 1A–C.
Figure 4:
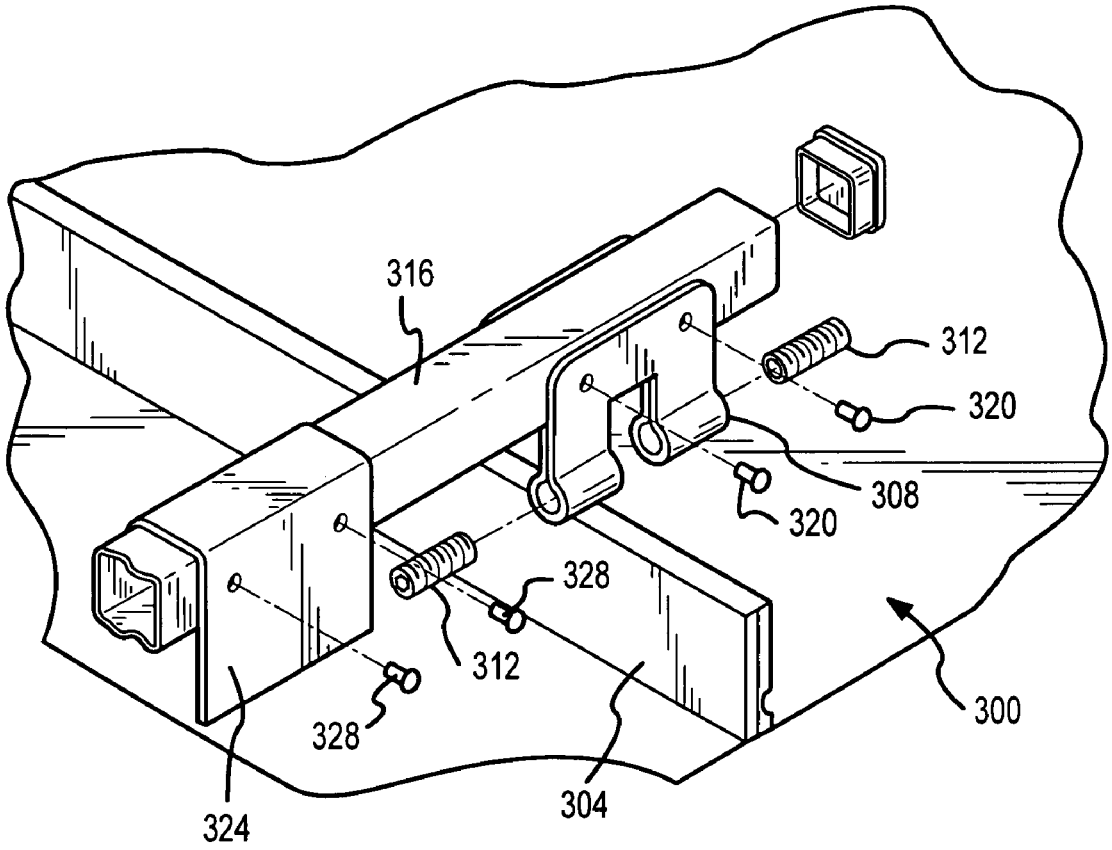
FIG.4 (PRIOR ART)
FIG. 4 is an end view of a prior art clamp that has been used with another prior art standing seam profile.
Figure 7D:
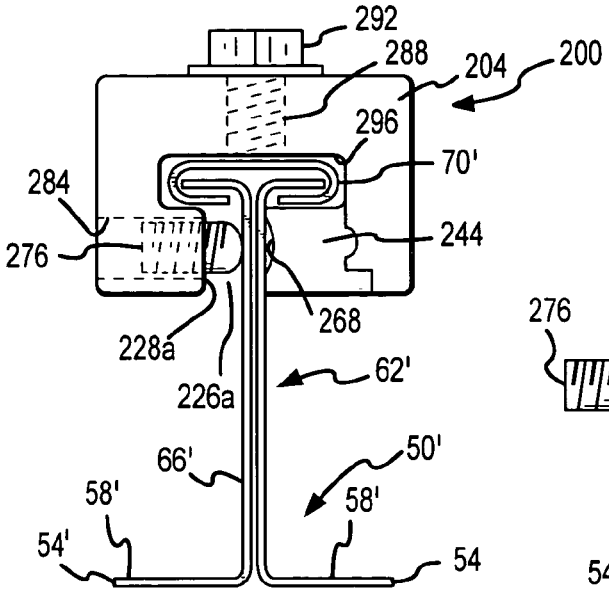
FIG. 7D is the two-piece clamp of FIG. 7A installed on the standing seam profile used by the metal panel assembly in FIG. 2C.
Figure 7C:
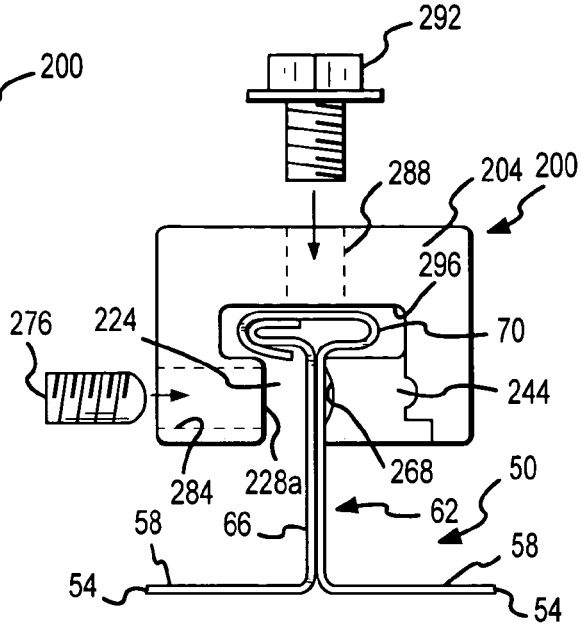
FIG. 7C is the two-piece clamp of FIG. 7A installed on the standing seam profile used by the metal panel assembly in FIGS. 2A–B.
Figure 7B:
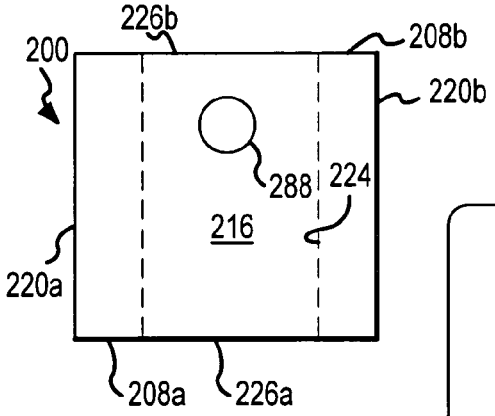
FIG. 7B is top view of the two-piece clamp of FIG. 7A.
Figure 7A:
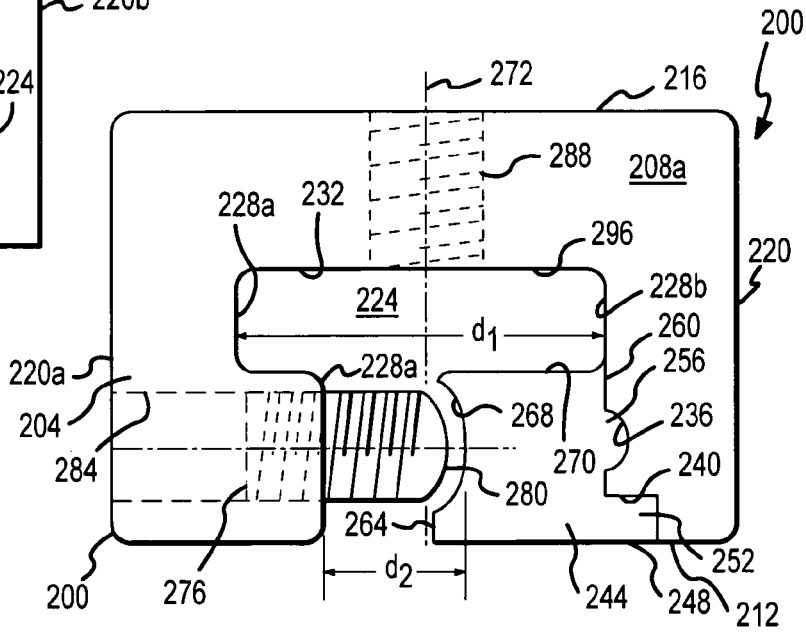
FIG. 7A is an end view of another embodiment of a two-piece clamp for use with the type of standing seam profile presented in FIGS. 2A–C.

Another embodiment of a clamp that may be used with panel assemblies having the type of standing seam profiles in FIGS. 2A–C is illustrated in FIGS. 7A–B in the form of a clamp 200. FIG. 7C illustrates this clamp 200 being mounted on the FIG. 2B configuration, while FIG. 7D illustrates this clamp 200 being mounted on the FIG. 2C configuration. The clamp 200 is functionally similar to the clamp 102 of FIGS. 5A–D and is oriented/installed in the same general manner on a standing seam, but its configuration has been adapted for the profile of the head 70, 70' of the standing seams 62, 62' of FIGS. 2B and 2C, respectively. Hereafter, the clamp 200 will be described only in relation to the FIG. 2B configuration.

The clamp 200 generally includes a unitary or one-piece clamp body 204 that may be made using the same type of materials and construction techniques discussed above in relation to the clamp body 106. The clamp body 204 is defined by a pair of clamp body ends or end surfaces 208*a*, 208*b* that are longitudinally spaced, a pair of laterally spaced and at least generally longitudinally extending clamp body side surfaces 220*a*, 220*b*, a clamp body upper surface 216, and a clamp body lower surface 212. Each of the clamp body surfaces 208, 220, 216, and 212 are at least generally planar in the illustrated embodiment, with the end surfaces 208*a*, 208*b* further being at least generally parallel to each other and also at least generally perpendicular with the clamp body upper surface 216, the clamp body lower surface 212, and the clamp body side surfaces 220; with the clamp body upper surface 216 and clamp body lower surface 212 further being at least generally parallel to each other and also at least generally perpendicular with both the clamp body side surfaces 220 and end surfaces 208; and with the clamp body side surfaces 220*a*, 220*b* being at least generally parallel to each other and at least generally perpendicular to the clamp body end surfaces 208, the clamp body upper surface 216, and the clamp body lower surface 212. Other profiles and orientations could be utilized for one or more of the clamp body surfaces 208, 220, 216, and 212, although having one or more of these surfaces 208, 220, 216, and 212 in an at least generally planar configuration provides one or more advantages.

An open or concave clamp body slot 224 having a pair of longitudinally spaced open ends 226 on the container body end surfaces 208*a*, 208*b* is formed on the clamp body lower surface 212 and extends at least generally toward, but not to, the clamp body upper surface 216. "Open" means that the clamp body slot 224 is on an exterior surface of the clamp body 204 and extends therewithin. The clamp body slot 224 is defined by a pair of laterally spaced and at least generally longitudinally extending slot sidewalls 228*a*, 228*b* that extend between the open ends 226*a* and 226*b* of the clamp body slot 224 and that are disposed in at least generally parallel relation. The slot sidewalls 228*a*, 228*b*, at least in the upper portion of the clamp body slot 122, are at least generally centrally disposed relative to a lateral reference axis 272 of the clamp body slot 224. The clamp body slot 224 further includes a slot base 232 that also extends at least generally longitudinally between the open ends 226, 226*b* of the clamp body slot 224, and that further extends at least generally laterally between the slot sidewalls 228*a*, 228*b*. A seam fastener hole 284 (e.g., threaded) extends from the clamp body side surface 220*a* to the slot sidewall 228*a* for receiving a seam fastener 276 (e.g., a threaded set screw or the like). A single seam fastener hole 284 could be utilized to attach the clamp 200 to the standing seam 50. Multiple seam fastener holes 284 may also be utilized to attach the clamp 200 to the standing seam 50 and that would then be longitudinally spaced along the length or longitudinal extent of the clamp body 204 (in the same direction represented by the arrow B in FIG. 5C for the case of the clamp 102). One or more mounting cavities 288 may be included on one more of the clamp body upper surface 216, the clamp body side surface 220*a*, and the clamp body side surface 220*b* and that extend within the clamp body 204 to allow for attachment of various structures/devices to the clamp 200. Typically each mounting cavity 288 will be in the form of a threaded hole or pilot hole for a thread-cutting fastener such that various structures/devices may be attached to the clamp 200 by threading an appropriate bolt or other fastener 292 into the desired/required mounting cavity 288.

The clamp 200 further includes a unitary or one-piece insert 244 that may be made using the same type of materials and construction techniques discussed above in relation to the insert 142. The insert 244 is disposed against at least a portion of the clamp body 204 that defines the clamp body slot 224, with at least part of the insert 244 being disposed in at least generally opposing relation to and in axial alignment with the seam fastener hole(s) 284. In the illustrated embodiment, the insert 244 interfaces with a lower portion of the slot sidewall 228*b*. However, the insert 244 could be configured to interface with any appropriate amount of the clamp body 204 that defines the clamp body slot 224. For instance, the insert 244 could interface with all or any portion of the slot sidewall 228*b*, the slot base 232, the slot sidewall 228*a*, or any combination thereof, and further in any configuration. What is of importance is that the disposition of the insert 244 within the clamp body slot 224 defines a seam profile slot 296. Although not required, preferably this seam profile slot 296 at least generally approximates the profile of the head 70 of the standing seam 62 on which the clamp 200 is installed. As such, it should be appreciated that changing the profile of the surfaces 264 and 270 of the insert 244 in the view illustrated in FIG. 7A, the size or configuration of the insert 244, the profile and/or location of the interface between the insert 244 and the clamp body 204, or any combination thereof will change the shape and/or size of the seam profile slot 296.

The insert 244 may also be of any appropriate length, including less than the length of the clamp body slot 224, the same as the clamp body slot 224, and greater than the clamp body slot 224. Multiple inserts 244 could also be utilized by the clamp 200 on the same side of the standing seam 62 on which the clamp 200 is to be installed, such as having a separate insert 244 for each seam fastener 276 that is used by the clamp 200 to attach the same to the standing seam 62. However, preferably the clamp 200 uses only a single insert 244, regardless of the number of seam fasteners 276 that are used by the clamp 200 for attachment to the standing seam 62.

Generally, the separate insert 244 allows the clamp 200 to be installed on a standing seam 62 without having to slide the clamp 200 onto a free end of the standing seam 62 and then along the axial extent of the standing seam 62 to the desired axial position. This is realized by configuring the insert 244 and/or the clamp body slot 224 so that the width of the seam profile slot 296 (again defined when the insert 244 is disposed in the clamp body slot 224) in the region thereof that will include the head 70 of the standing seam 62 is greater, and more preferably significantly greater, than the width of the seam profile slot 296 that would be disposed below the head 70 of the standing seam 62. In one embodiment, the maximum width of the seam profile slot 296 in that portion thereof which receives the head 70 of the standing seam 62 (represented by the dimension $d_1$ in FIG. 7A) is generally at least (more than three times in the illustrated embodiment) about twice as large as the width of the seam profile slot 296 that is disposed below the head 70 of the standing seam 62 (represented by the dimension $d_2$ in FIG. 7A).

The insert 244 generally includes a seam extension interface surface 264 that interfaces with the extension 66 of the standing seam 62 on which the clamp 200 is installed. The vertical extent of the insert 244 and/or clamp body 204 may be of any size such that the insert 244 may interface with the extension 66 along any portion thereof (e.g., the insert 244, the clamp body 204, or both could be configured to enclosure the entire vertical extent of the standing seam 62 or any portion thereof). Initially, the seam extension interface surface 264 of the insert 244 preferably does not extend from the second slot sidewall 228*b* beyond the lateral central reference axis 272 of the clamp body slot 244. In one embodiment, the portion of the seam extension interface surface 264 that is closest to the lateral central reference axis 272 is spaced therefrom a distance that is at least generally equal to the wall thickness of one of the panels 54 of the panel assembly 50 on which the clamp 200 is installed.

A portion of the extension 66 of the standing seam 62 is retained between the tip 280 of the seam fastener 276 and the aligned portion of the seam extension interface surface 264 of the insert 244. In this regard and after the clamp 200 has been positioned on the standing seam 62 in a manner which will be described in more detail below, the seam fastener 276 is advanced through the clamp body 204 and past the slot sidewall 228*a* to engage an aligned portion of the extension 66 of the standing seam 62 and move the same into forcible engagement with an aligned portion of the insert 244. Retention of the clamp 200 on the standing seam 62 may be enhanced by including a recess on at least that portion of the seam extension interface surface 264 that is aligned with the seam fastener 276 to "dimple" the engaged portion of the extension 66 in a discrete area corresponding with the tip 280 of the seam fastener 276. In the illustrated embodiment where the insert 244 is an extrusion, this recess may be provided by a seam interface groove 268 that extends the entire length of the insert 244 and which may be formed in the extrusion process. Another less desirable option the would be to extrude, machine, or cast the insert 244 to have a planar seam extension interface surface 264 (not shown), and to thereafter machine an appropriate recess into this surface at least in axial alignment with each seam fastener 276 that is used by in the clamp 200 to secure the same to the standing seam 62. In one embodiment, the depth of the portion of the seam extension surface 264 of the insert 244 that is aligned with the seam fastener 276 is recessed from adjacent portions of the surface 264 a distance at least generally similar to the radius of the tip 280 of the seam fastener 276. That is, each seam fastener 276 used to attach the clamp 200 to the standing seam 62 preferably has a convex or rounded tip 280 so as to reduce the potential for piercing or marring the standing seam 62. Preferably the corresponding recess formed on the seam extension interface surface 260 of the insert 244 at least generally matches this profile in at least in one dimension (e.g., the radius which defines the 268 preferably is at least generally the same as the radius which defines the tip 280 of the seam fastener 276. It should be appreciated that the seam extension interface surface 264 could also use the same configuration as presented in FIGS. 6A–C that was discussed above.

Movement of each seam fastener 276 in the above-noted manner not only secures the extension 66 of the standing seam 62 between the seam fastener 276 and the insert 244, but it also forcibly engages the insert 244 against the slot sidewall 228*b* of the clamp body 204. Certain features of the clamp 200 enhance this interface between the insert 244 and the clamp body 204. In this regard, the slot sidewall 228*b* generally includes a clamp body registration structure 236 (e.g., a groove) that preferably extends the full length of the clamp body 204 or the entire length between the clamp body end surfaces 208*a*, 208*b* (or stated another way the entire length of the clamp body slot 224), while a sidewall interface surface 260 of the insert 244 includes an insert registration structure 256 (e.g., a rail, rib, or other protrusion) that preferably extends the full length of the insert 244 and that appropriately interfaces with the clamp body registration structure 236. The registration structures illustrated for the insert 244 and the clamp body 204 that are illustrated in FIGS. 7A–D could be reversed. Other registering structures could be used and of any appropriate size/configuration as well (e.g., one or more "pin/button" and "hole/detent" pairs). In any case, this not only registers the insert 244 in a predetermined position relative to the slot sidewall 228*b* of the clamp body 204, but it also reduces the potential for the insert 244 and clamp body 204 becoming disengaged during use of the clamp 200. Consider the case where a force is applied to the clamp 200 after being installed on the standing seam 62 and in a direction which would tend to pull the clamp 200 off of the seam 62 (e.g., by a pivoting-like action in the general direction of the longitudinal extent of the seam 62). An exclusively planar and continuous interface between the slot sidewall 228*b* and the insert 244 (not shown) would allow for a sliding motion between the slot sidewall 228*b* and the insert 244 upon these forces exceeding a certain magnitude. Significantly greater forces of this type would be required to realize relative movement between the slot sidewall 228*b* of the clamp body 204 and the sidewall interface surface 260 of the insert 244 when using the clamp body registration structure 236 and the insert registration structure 256, or other appropriate types of registering structures.

The insert 244 also includes an insert lower surface 248 that may be coplanar with the clamp body lower surface 212. Part of this insert lower surface 248 may be defined by a leg 252 of the insert 244 that preferably extends the entire length of the insert 244. This leg 252 may facilitate the installation of the insert 244 into the lower portion of the clamp body slot 224 when installing the clamp 200 on a standing seam 62 by providing a convenient "handle" of sorts for the installer. This leg 252 is disposed within a notch 240 that is formed in the clamp body lower surface 212 alongside the lower extreme of the slot sidewall 228*b*, and that preferably at least generally extends the entire length of the clamp body slot 244. The interface between the leg 242 and the notch 240 further serves to register the insert 244 in a predetermined position relative to the clamp body 204. This feature may be used by any of the inserts for multi-piece clamps described herein.

The insert 244 further includes a seam head interface surface 270 that projects at least generally toward the slot base 232 of the clamp body slot 224. Generally, an upper portion of the slot sidewall 228*a*, the slot base 232, an upper portion of the slot sidewall 228*b*, and the seam head interface surface 270 of the insert 244 collectively define a cavity in which the head 70 of the standing seam 62 may be disposed. Preferably, the upper portion of the slot sidewall 228*a*, the slot base 232, the upper portion of the slot sidewall 228*b*, and the seam head interface surface 270 of the insert at least generally approximate the contour of the corresponding portion of the head 70 of the standing seam 62. Once again, the portion of the insert 244 that defines at least part of the seam profile slot 296 may be of any configuration and may define any desired/required portion of the seam profile slot 296.

Based upon the foregoing description of the clamp 200 and its construction, it should be appreciated that the clamp 200 alleviates the need for sliding the clamp 200 onto one of the ends of the standing seam 62 in order to install the same. Installation of the clamp 200 instead may be accomplished in the same general manner discussed above in relation to the clamp 102.

Figure 8:
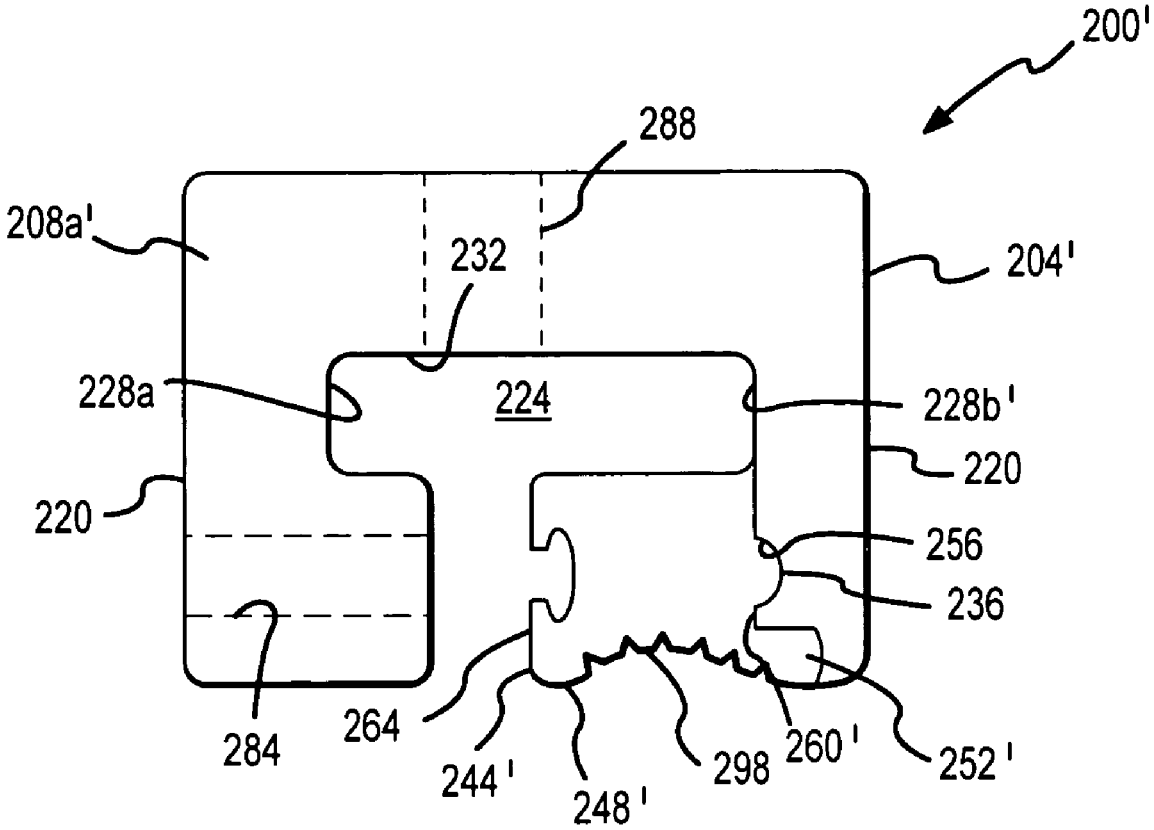
FIG. 8 is an end view of a variation of the two-piece clamp of FIGS. 7A–D.

An alternative configuration for clamp 200 of FIGS. 7A–D is illustrated in FIG. 8 in the form of a clamp 200'. Components of the clamp 200' that correspond with components of the clamp 200 of FIGS. 7A–D are identified with the same reference numerals. A "single prime" designation is used to identify those particular parts or surfaces which differ in at least some respect. The primary distinction between the clamp 200 of FIGS. 7A–D and the clamp 200' of FIG. 8 is in relation to the lower surface 248' of the insert 142'. Generally, the lower surface 248' includes a generally concave finger grip 298 that includes a plurality of teeth, serrations or the like for facilitating installation of the insert 142'. This feature may be utilized by any of the inserts described herein for multi-piece clamps.

Figure 9:
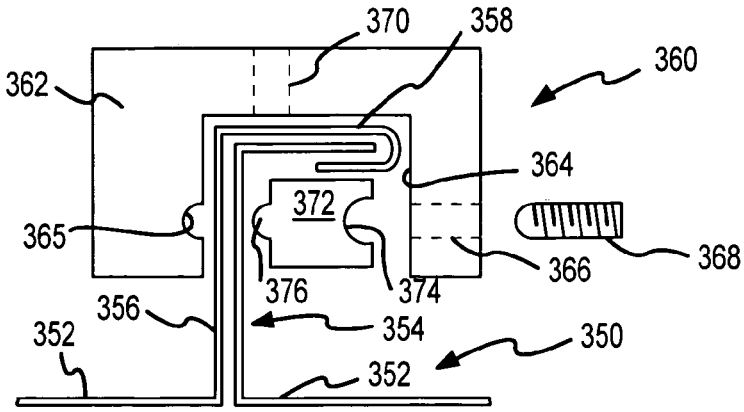
FIG. 9 is an end view of another embodiment of a two-piece clamp installed on an inverted "L" standing seam profile panel assembly.

Another embodiment of a multi-piece clamp is illustrated in FIG. 9 in the form of a clamp 360. The clamp 360 is mounted on a standing seam 354 of a panel assembly 350 that is defined by a plurality of interconnected panels 352. The standing seam 354 includes an extension 356 that is at least generally vertically disposed and a head 358 that is at least generally horizontally disposed on a distal portion of the standing seam 354. The standing seam 354 is often characterized as being an "inverted L" type standing seam.

The clamp 360 generally includes a clamp body 362. The clamp body 362 includes: a concave or open clamp body slot 364; at least one seam fastener hole 366 disposed on one side of the clamp body slot 364 (e.g., a single seam fastener hole 366; a plurality of seam fastener holes 366 spaced along at least a portion of the length of the clamp body slot 364 on one side of the clamp body slot 364); a seam fastener 368 for each seam fastener hole 366; at least one seam recess 365 formed in the clamp body 362 on the opposite side of the clamp body slot 364 than the seam fastener hole(s) 366 and that may be in alignment with each seam fastener hole 366 (e.g., a discrete dimple, a groove that runs along at least a portion of the length of the clamp body slot 364); and at least one mounting cavity 370 on an exterior surface of the clamp body 362 to provide attachment capabilities to the clamp 360.

The clamp 360 also includes an insert 372 that is at least partially disposed within the clamp body slot 364 on the same side of the extension 356 of the standing seam 354 as the seam fastener(s) 368. At least part of the insert 372 is disposed below the head 358 of the standing seam 354, and at least part of the insert 372 is axially aligned with the seam fastener hole(s) 366. In the illustrated embodiment the insert 372 is completely disposed within the clamp body slot 364 and is disposed entirely below the head 358 of the standing seam 354. The insert 372 generally includes at least one seam fastener receptacle 374 (e.g., a discrete dimple, a groove that runs along at least a portion of the length of the insert 372). Each seam fastener hole 366 in the clamp body 362 is aligned with at least part of a seam fastener receptacle 374 on the insert 372 to register the seam fastener 368 relative to the insert 372. The insert 372 also includes a convex protrusion 376 (e.g., a discrete button; a rib or rail that runs along at least part of the length of the insert 372 that is aligned with the seam recess 365 or a portion thereof).

When the clamp 360 is installed on the standing seam 354, each seam fastener 368 is directed through its corresponding seam fastener hole 366 so as to extend into the clamp body slot 364. Each seam fastener 368 preferably seats within a fastener receptacle 374 on the insert 372 to force the insert 372 into engagement with the extension 356 of the standing seam 354. This in turn forces the extension 356 of the standing seam 354 into engagement with an opposing and aligned portion of the clamp body 362 that defines the clamp body slot 364. A deformation or "dimpling" of the extension 356 of the standing seam 354 in the direction of the forces applied by the seam fastener(s) 368 is provided by the protrusion 376 on the insert 372 pushing the extension 356 of the standing seam 354 into an aligned seam recess 365 on the clamp body 362. This places the insert 372 entirely in compression in the installed position on the standing seam 354. Each seam fastener 368 that is used to assemble the clamp 360, to secure the clamp 360 to the standing seam 354, or both, is also entirely in compression, and further is preferably disposed below the head 358 of the standing seam 354.

Figure 10:
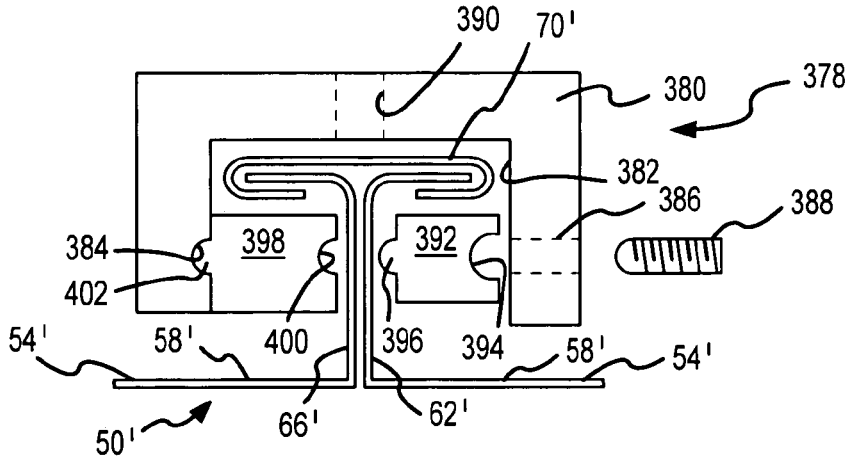
FIG. 10 is an end view of a three-piece clamp installed on the type of standing seam profile illustrated in FIGS. 2A–C.

Another embodiment of a multi-piece clamp is illustrated in FIG. 10 in the form of a clamp 378. The clamp 378 is mounted on the standing seam 62' of the panel assembly 50' that was discussed above in relation to FIGS. 2A–C. The clamp 378 generally includes a clamp body 380. The clamp body 380 includes: a concave or open clamp body slot 382; at least one seam fastener hole 386 disposed on one side of the clamp body slot 382 (e.g., a single seam fastener hole 386; a plurality of seam fastener holes 386 spaced along at least a portion of the length of the clamp body slot 382); a seam fastener 388 for each seam fastener hole 386; at least one clamp body registration member 384 formed in the clamp body 380 on the opposite side of the clamp body slot 382 than the seam fastener hole(s) 386 (e.g., a discrete dimple, a groove that runs along at least part of the length of the clamp body slot 382); and at least one mounting cavity 390 on an exterior surface of the clamp body 380 to provide attachment capabilities to the clamp 378.

The clamp 378 also includes a first insert 372 that is at least partially disposed within the clamp body slot 382 on the same side of the extension 66' of the standing seam 62' as the seam fastener(s) 388. At least part of the insert 392 is disposed below the head 70' of the standing seam 62' and in alignment with the seam fastener hole(s) 386. In the illustrated embodiment, the first insert 392 is completely disposed within the clamp body slot 382 and is disposed entirely below the head 70' of the standing seam 62'. The first insert 392 generally includes at least one seam fastener receptacle 394 (e.g., a discrete dimple, a groove that runs along at least part of the length of the first insert 392). Each seam fastener hole 386 in the clamp body 380 is aligned with a seam fastener receptacle 394 on the first insert 392 to register each seam fastener 388 relative to the first insert 392. The first insert 392 also includes a convex protrusion 396 (e.g., a discrete button; a rib or rail that runs along at least part of the length of the first insert 392).

The clamp 378 also includes a second insert 398 that is at least partially disposed within the clamp body slot 382 on the opposite side of the extension 66' of the standing seam 62' as the first insert 392. At least part of the second insert 398 is disposed below the head 70' of the standing seam 62' and in alignment with the seam fastener hole(s) 386. In the illustrated embodiment, the second insert 398 is completely disposed within the clamp body slot 382 and is disposed entirely below the head 70' of the standing seam 62'. The second insert 392 generally includes at least one seam recess 400 (e.g., a discrete dimple; a groove that runs on at least part of the length of the second insert 398). Each protrusion 396 on the first insert 392 is also aligned with a seam recess 400 on the second insert 398 or a portion thereof. The second insert 398 also includes an insert registration member 402 (e.g., a discrete button; a rib or rail that runs along at least part of the length of the second insert 398). This insert registration member 402 interfaces with the clamp body registration member 384 to register the position of the second insert 398 relative to the clamp body 380 during installation of the clamp 378, and further to restrict relative movement between the second clamp body insert 398 relative to the clamp body 380.

When the clamp 378 is installed on the standing seam 62', each seam fastener 388 is directed through its corresponding seam fastener hole 386 so as to extend into the clamp body slot 382. Each seam fastener 388 seats within a seam fastener receptacle 394 on the first insert 392 to force the first insert 392 into engagement with the extension 66' of the standing seam 50'. This in turn forces the extension 66' of the standing seam 50' into engagement with an opposing and aligned portion of the second insert 398. A deformation or "dimpling" of the extension 66' of the standing seam 62' in the direction of the forces applied by the seam fastener(s) 388 is provided by the protrusion(s) 396 on the first insert 392 pushing the extension 66' of the standing seam 354 into an aligned seam recess 400 on the second insert 398. This places both the first insert 392 and the second insert 398 entirely in compression when installed on the standing seam 62'. Each seam fastener 388 that is used to assemble the clamp 378, to secure the clamp 378 to the standing seam 62', or both, is also entirely in compression and further is preferably disposed below the head 70' of the standing seam 62'.

Figure 11:
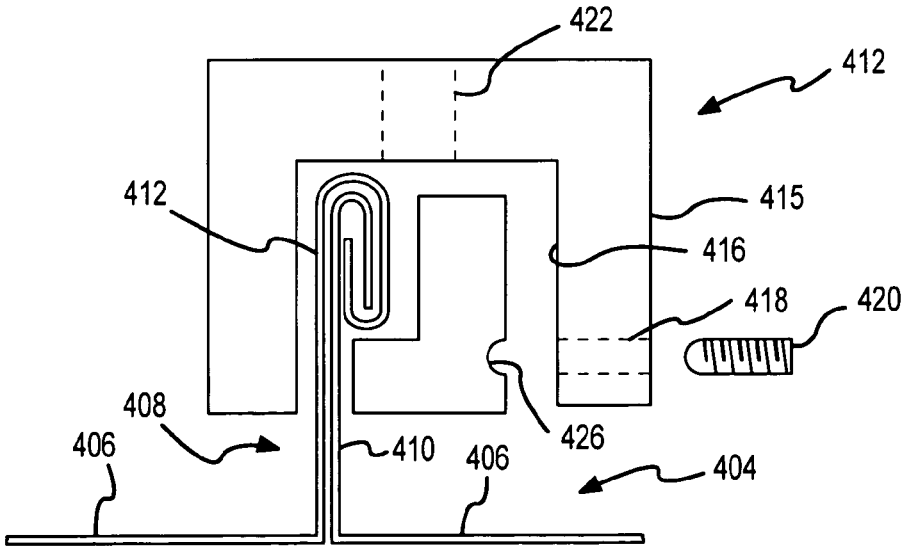
FIG. 11 is an end view of another embodiment of a two-piece clamp installed on a double-folded vertical seam profile.

Another embodiment of a multi-piece clamp is illustrated in FIG. 11 in the form of a clamp 414. The clamp 414 is mounted on a standing seam 408 of a panel assembly 404 that is defined by a plurality of interconnected panels 406. The standing seam 408 includes an extension 410 that is at least generally vertically disposed and a head 412 that is at least generally vertically disposed, although the head 412 is enlarged in relation to the extension 410. The profile of the standing seam 408 is often characterized as a double-folded vertical seam configuration.

The clamp 414 generally includes a clamp body 415. The clamp body 415 includes: a concave or open clamp body slot 416; at least one seam fastener hole 418 disposed on one side of the clamp body slot 416 (e.g., a single seam fastener hole 418; a plurality of seam fastener holes 418 spaced along at least part of the length of the clamp body slot 416); a seam fastener 420 for each seam fastener hole 418; and at least one mounting cavity 422 on an exterior surface of the clamp body 415 to provide attachment capabilities to the clamp 414.

The clamp 414 also includes an insert 424 that is at least partially disposed within the clamp body slot 416 on the same side of the extension 410 of the standing seam 408 as the seam fastener(s) 420. At least part of the insert 424 is disposed below the head 412 of the standing seam 408 in alignment with the seam fastener hole(s) 418. In the illustrated embodiment the insert 424 is completely disposed within the clamp body slot 416 and is both disposed alongside and below the head 412 of the standing seam 408. The insert 424 generally includes at least one fastener receptacle 426 (e.g., a discrete dimple, a groove that runs along at least part of the length of the insert 424). Each seam fastener hole 418 in the clamp body 415 is aligned with a fastener receptacle 426 on the insert 424. Although not shown, the insert 424 and clamp body 415 could include the above-noted types of structures for deforming or dimpling the extension 410 of the standing seam 408.

When the clamp 414 is installed on the standing seam 408, each seam fastener 420 is directed through its corresponding seam fastener hole 418 so as to extend into the clamp body slot 416. Each seam fastener 420 seats within a fastener receptacle 426 on the insert 424 to force the insert 424 into engagement with the extension 410 of the standing seam 408. This in turn forces the extension 410 of the standing seam 408 into engagement with an opposing and aligned portion of the clamp body 415 that defines the clamp body slot 416. This places the insert 424 entirely in compression in the installed position on the standing seam 408. Each seam fastener 420 that is used to assemble the clamp 414, to secure the clamp 414 to the standing seam 408, or both, is also entirely in compression and further is preferably disposed below the head 412 of the standing seam 408.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An assembly, comprising:

a panel assembly comprising a plurality of laterally spaced and longitudinally extending standing seams; and a clamp mounted on a first said standing seam and that comprises:

a clamp body that comprises a concave clamp body slot wherein said clamp body slot comprises first and second open ends and first and second slot sidewalls that are disposed in spaced relation and that extend between said first and second open ends, wherein said clamp body slot is disposed on said first said standing seam, and wherein an entirety of said first slot sidewall and said first said standing seam are separated by an open space;

a first insert that is a separate piece than said clamp body and that is positioned between said first said standing seam and said second slot sidewall; and a first seam fastener that extends through said clamp body, through said first slot sidewall, through said open space, and into engagement with said first said standing seam to force said first said standing seam against said first insert and to in turn force said first insert against said second slot sidewall.

2. An assembly, as claimed in claim 1, wherein:

said first insert comprises a first recess that projects toward said first said standing seam, wherein said first seam fastener is axially aligned with at least a portion of said recess, and wherein said first seam fastener deforms a portion of said first said standing seam into at least a portion of said recess.

3. An assembly, as claimed in claim 1, wherein:

said first insert comprises first and second cantilevers, wherein said first seam fastener forces said first said standing seam into engagement with said first and second cantilevers, deflects said first and second cantilevers in a direction of said second slot sidewall, and forces said first insert against said second slot sidewall.

4. An assembly, as claimed in claim 1 ,wherein:

said clamp body slot further comprises a slot base that extends between said first and second open ends and further that extends between said first and second slot sidewalls, wherein said first insert interfaces with a first portion of said second slot sidewall and is spaced from said slot base, wherein a second portion of said clamp body slot extends above where said first insert interfaces with said second slot sidewall to said slot base, and wherein a distance between said first slot sidewall and a portion of said first insert that is aligned with said first seam fastener is less than a distance between said first and second slot sidewalls in said second portion of said clamp body slot.

5. An assembly, as claimed in claim 1, wherein:

positioning said first insert in said clamp body slot defines a seam profile slot, wherein a first width of said seam profile slot in an area that contains a head of said first said standing seam is greater than a second width of said seam profile slot that is disposed below the head of said first said standing seam and which is defined at least in part by said first insert.

6. An assembly, as claimed in claim 5, wherein:

a magnitude of said first width is at least generally about twice a magnitude of said second width.

7. An assembly, as claimed in claim 1, wherein:

said clamp body slot further comprises a slot base that extends between said first and second open ends and further that extends between said first and second slot sidewalls, wherein said first insert comprises first and second surfaces, wherein said first surface projects at least generally toward said first seam fastener, wherein said second surface projects at least generally toward said slot base, and wherein a portion of said clamp body slot that includes said slot base, along with said second surface of said first insert, collectively define at least a portion of a cavity which at least generally approximates a profile of a head of said first said standing seam.

8. An assembly, comprising:

a panel assembly comprising a plurality of laterally spaced and longitudinally extending standing seams; and a clamp mounted on a first said standing seam and that comprises:

a clamp body that comprises a concave clamp body slot, wherein said clamp body slot comprises first and second open ends and first and second slot sidewalls that are disposed in spaced relation and that extend between said first and second open ends, wherein said clamp body slot is disposed on said first said standing seam;

a first insert that is a separate piece than said clamp body, and further that is disposed between said first said standing seam and said second slot sidewall, wherein said first insert comprises first and second cantilevers that face said first slot sidewall; and a first seam fastener that extends through said clamp body, through said first slot sidewall, and into engagement with said first said standing seam, wherein said first seam fastener forces said first said standing seam into engagement with said first and second cantilevers, deflects said first and second cantilevers in a direction of said second slot sidewall, and forces said first insert against said second slot sidewall.

9. An assembly, as claimed in claim 8, wherein:

said first standing seam comprises an extension that extends outwardly from adjacent portions of said panel assembly, as well as an end-defining head, wherein said clamp body slot further comprises a slot base that extends between said first and second slot sidewalls, wherein said head of said first standing seam is disposed in said clamp body slot such that said slot base is disposed beyond said head of said first standing seam, and wherein said first insert is spaced from said slot base.

10. An assembly, as claimed in claim 9, wherein:

said first insert is disposed below said head of said first standing seam.

11. An assembly, as claimed in claim 8, wherein:

said first insert comprises a seam extension interface surface, wherein said plurality of panels are of a first wall thickness, wherein a midpoint between said first and second slot sidewalls of said clamp body slot along a path that intersects with said seam extension interface surface of said first insert is spaced from said seam extension interface surface of said first insert by a distance at least generally equal to said first wall thickness of said a plurality of panels.

12. An assembly, comprising:

a panel assembly comprising a plurality of standing seams, wherein each said standing seam comprises an extension that extends outwardly from adjacent portions of said panel assembly, as well as an end-defining head; and a clamp mounted on a first said standing seam and that comprises:

a clamp body that comprises a concave clamp body slot, wherein said clamp body slot comprises first and second open ends, first and second slot sidewalls that are disposed in spaced relation and that extend between said first and second open ends, and a slot base that extends between said first and second slot sidewalk, wherein said head of said first said standing seam is disposed in said clamp body slot such that said slot base is disposed beyond said head of said first standing seam;

a first insert that is a separate piece than said clamp body, and further that is disposed between said first said standing seam and said second slot sidewall, wherein an entirety of said first insert is disposed below said head of said first standing seam; and at least one sewn fastener that extends through said clamp body and into said clamp body slot.

13. An assembly, as claimed in claim 12, wherein:

a said clamp body is of one-piece construction.

14. An assembly, as claimed in claim 12, wherein:

said at least one seam fastener comprises a first seam fastener, wherein said first seam fastener and said first insert are disposed on opposite sides of said first said standing seam, wherein said first seam fastener extends through said first slot sidewall, engages an aligned portion of said first said standing seam, and forces said aligned portion of said first said standing seam into engagement with said first insert, which in turn forces said first insert into engagement with said second slot sidewall.

15. An assembly, as claimed in claim 12, wherein:

said at least one seam fastener comprises a first scan fastener, wherein said first seam fastener and said first insert are disposed on a same side of said first said standing seam, wherein said first seam fastener extends through said second slot sidewall, engages an aligned portion of said first insert, and forces said first insert into engagement with an aligned portion of said first said standing seam, which in turn forces said aligned portion of said first said standing seam into engagement with said first slot sidewall.

16. An assembly, as claimed in claim 12, further comprising:

a second insert that is at least partially disposed within said clamp body slot, wherein said first and second inserts art disposed on opposite sides of said first said standing seam, wherein said at least one seam fastener comprises a first seam fastener, wherein said first seam fastener extends through said first slot sidewall, engages an aligned portion of said second insert, and forces said second insert into engagement with an aligned portion of said first said standing seam in a direction of an aligned portion of said first insert, which in turn forces said first insert into engagement with said second slot sidewall.

17. An assembly, as claimed in claim 12, wherein:

said first insert comprises a first aperture that extends within said first insert and intersects with a second aperture, wherein said second aperture extends beyond said first aperture in a first direction which is at least generally parallel with a direction which said clamp body slot extends within said clamp body to define a first deflectable cantilever, and also extends beyond said first aperture in a second direction which is opposite said first direction and which is also at least generally parallel with said direction which said clamp body slot extends within said clamp body to define an oppositely disposed second deflectable cantilever.

18. An assembly, as claimed in claim 17, wherein:

said first insert comprises a slot and a groove that each extend at least generally along an entire length of said first insert, wherein said slot comprises said first recess and wherein said groove comprises said second recess.

19. An assembly, as claimed in claim 12, wherein:

said at least one seam fastener comprises a first seam fastener, wherein a first portion of said clamp body slot extends above where said first insert interfaces with said second slot sidewall to said slot base, and wherein a distance between said first slot sidewall and a portion of said first insert that is aligned with said first seam fastener is less than a distance between said first and second slot sidewalk in said first portion of said clamp body slot.

20. An assembly, as claimed in claim 12, wherein:

said first insert interfaces with said second slot sidewall, wherein said second slot sidewall comprises a first registration member and said first insert comprises a second registration member that interfaces with said first registration member.

21. An assembly, as claimed in claim 12, wherein:

a lower surface of said first insert is flush with a lower surface of said clamp body, wherein said clamp body slot is disposed on said lower surface of said clamp body.

22. An assembly, as claimed in claim 12, wherein:

said first insert interfaces with a portion of said second slot sidewall along at least generally an entire length of said clamp body slot.

23. An assembly, as claimed in claim 12, wherein:

said first insert comprises a seam extension interface surface, wherein said panel assembly comprises a plurality of panels of a first wall thickness that are interconnected to define said plurality of standing seams, wherein a midpoint between said first and second slot sidewalk of said clamp body slot along a path that intersects with seam extension interface surface of said first insert is spaced from said seam extension interface surface of said first insert by a distance at least generally equal to said first wall thickness of said a plurality of panels.

24. An assembly, as claimed in claim 12, wherein:

said first insert comprises an extension that is disposed within a notch in a portion of a lower surface of said clamp body, wherein said clamp body slot is on said lower surface of said clamp body.

25. An assembly, comprising:

a panel assembly comprising a plurality of laterally spaced and longitudinally extending standing seams, that in turn comprises a first standing seam; and a clamp mourned on said first standing seam and that comprises:

a clamp body that comprises a concave clamp body slot wherein said clamp body slot comprises first and second open ends and first and second slot sidewalls that are disposed in spaced relation and that extend between said first and second open ends, and wherein said clamp body slot is disposed on said first standing seam;

a first insert that is a separate piece than said clamp body, and further that is positioned between said first slot sidewall and said first standing seam within said clamp body slot;

a second insert that is a separate piece than said clamp body and said first insert, and further that is positioned between said first standing seam and said second slot sidewall within said clamp body slot wherein said first and second inserts are thereby disposed on opposite sides of said first standing seam; and a first seam fastener that extends through said clamp body, through said first slot sidewall, and into engagement with said first insert, wherein said first insert, said first standing seam, and said second insert are compressed between said first seam fastener and said second slot sidewall.

26. An assembly, as claimed in claim 25, wherein;

said first seam fastener engages only an exterior surface of said first insert.

27. An assembly, as claimed in claim 25, wherein:

said first insert comprises a first seam fastener receptacle, wherein said first seam fastener is disposed within said first seam fastener receptacle.

28. An assembly, as claimed in claim 27, wherein:

said first insert comprises a protrusion, wherein said second insert comprises a recess, and wherein said protrusion of said first insert deflects an aligned portion of said first standing seam into said recess of said second insert.

29. An assembly, comprising:

a panel assembly comprising a plurality of laterally spaced and longitudinally extending standing seams, that in turn comprises a first standing seam; and a clamp mounted on said first standing seam and that comprises:

a clamp body that comprises a concave clamp body slot, wherein said clamp body slot comprises first and second open ends and first and second slot sidewalls that are disposed in spaced relation and that extend between said first and second open ends, and wherein said clamp body slot is disposed on said first standing seam;

a first insert that is a separate piece than said clamp body, and further that is positioned between said first slot sidewall and said first standing seam within said clamp body slot, wherein said first insert comprises a first seam fastener receptacle; and a first seam fastener that extends through said clamp body, through said first slot sidewall, and into said first seam fastener receptacle.

* * * * *